US008622503B2

(12) United States Patent
Sumi

(10) Patent No.: US 8,622,503 B2
(45) **Date of Patent: *Jan. 7, 2014**

(54) INKJET IMAGE FORMING APPARATUS, METHOD OF DESIGNING SAME AND METHOD OF IMPROVING IMAGE FORMATION QUALITY

(75) Inventor: Katsuto Sumi, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 199 days.

This patent is subject to a terminal disclaimer.

(21) Appl. No.: 13/073,728

(22) Filed: Mar. 28, 2011

(65) Prior Publication Data

US 2011/0234697 A1 Sep. 29, 2011

(30) Foreign Application Priority Data

Mar. 29, 2010 (JP) ..... 2010-075748

(51) Int. Cl.
*B41J 29/38* (2006.01)

(52) U.S. Cl.
USPC ..... 347/16; 347/19

(58) Field of Classification Search
USPC ..... 347/16, 19
See application file for complete search history.

(56) References Cited

U.S. PATENT DOCUMENTS

| | | | | |
|---|---|---|---|---|
| 5,587,729 | A | 12/1996 | Lee et al. | |
| 6,755,504 | B2 | 6/2004 | Tee et al. | |
| 7,530,664 | B2 | 5/2009 | Shimazaki et al. | |
| 2005/0028630 | A1 | 2/2005 | Hagihara | |
| 2006/0050096 | A1 | 3/2006 | Chiwata | |
| 2009/0219373 | A1 * | 9/2009 | Tabata et al. | 347/104 |

FOREIGN PATENT DOCUMENTS

| | | | | |
|---|---|---|---|---|
| JP | 55073560 | A | * | 6/1980 |
| JP | 10-235854 | A | | 9/1998 |
| JP | 2001-34022 | A | | 2/2001 |
| JP | 2005-69458 | A | | 3/2005 |
| JP | 2005-91942 | A | | 4/2005 |
| JP | 2006-69123 | A | | 3/2006 |
| JP | 2007-9969 | A | | 1/2007 |

* cited by examiner

*Primary Examiner* — Matthew Luu
*Assistant Examiner* — Justin Seo
(74) *Attorney, Agent, or Firm* — Birch, Stewart, Kolasch & Birch, LLP

(57) ABSTRACT

An inkjet image forming apparatus includes: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, wherein: in a case where rotational non-uniformity can occur Nm times for each revolution of the motor (where Nm is a natural number), and when Pv represents a spatial period representing an amount of the relative movement in the first direction on the image formation receiving medium corresponding to 1/Nm revolution of the motor, and when OSy represents an offset distance in the first direction of a pair of nozzles which form dots that are mutually adjacent in a second direction perpendicular to the first direction on the image formation receiving medium, of the plurality of nozzles arranged two-dimensionally, then relationship of OSy≈k×Pv (where k is a natural number) is satisfied.

10 Claims, 23 Drawing Sheets

INKJET IMAGE FORMING APPARATUS, METHOD OF DESIGNING SAME AND METHOD OF IMPROVING IMAGE FORMATION QUALITY

BACKGROUND OF THE INVENTION

1. Field of the Invention

The present invention relates to an inkjet image forming apparatus, and more particularly to technology for improving image formation quality (image quality) in an inkjet image forming apparatus based on a single pass method which is equipped with an inkjet head having nozzles in a two-dimensional configuration.

2. Description of the Related Art

In the field of inkjet image formation, an inkjet image formation method (single pass method) is known in which, in order to achieve high image formation resolution and high productivity, head modules comprising a plurality of nozzles arranged in a two-dimensional configuration are formed, a long head (known as a "page-wide head" or "full line type head") which covers an image formation area spanning the entire width of the paper is composed by aligning a plurality of sub-heads which are constituted by the head modules, in the paper width direction (hereinafter, called the "x direction"), and an image is formed on the paper by performing just one relative scanning action of this long head and the paper in a direction (hereinafter, called the "y direction") which is perpendicular to the x direction.

A single-pass composition of this kind employs relative movement of the head and paper (a paper conveyance system which holds and conveys the paper), and therefore the head and the paper are not unified (in a fixed positional relationship) and relative displacement or vibration may occur in directions other than the relative scanning direction (y direction) during the image formation process. The causes of this relative displacement and vibration include, for instance, various mechanical shocks caused internally and externally to the image forming apparatus, displacement caused by the drive system for driving various moving parts including the paper conveyance system, and so on, and such factors manifest themselves as relative vibrations between the head and paper. Of the relative vibration between the head and the paper, the vibration in the x direction in particular generates non-uniformity which causes problems of image quality in a two-dimensional nozzle arrangement.

In relation to relative vibration of the head and the paper, Japanese Patent Application Publication No. 10-235854 discloses technology for reducing image abnormalities (band-shaped "vertical stripes" extending in the paper conveyance direction (y direction)) which are caused by abnormal ejection dots, by oscillating or moving a head in a direction (x direction) perpendicular to the y direction, in an inkjet apparatus based on a single pass method employing a line head having one-dimensional arrangement of nozzles.

The apparatus composition in Japanese Patent Application Publication No. 10-235854 prevents, due to its one dimensional nozzle arrangement, problems of image quality caused by relative vibration and relative movement of the head and the paper (recording paper) in the x direction and achieves a reduction in non-uniformity by using other nozzles to compensate for recording of missing dots by making active use of the vibration in the x direction. However, in the case of a two-dimensional nozzle arrangement, as described hereinafter, a major problem which is characteristic of a two-dimensional arrangement occurs.

DESCRIPTION OF TECHNICAL PROBLEM

In a head having a two-dimensional nozzle arrangement, of the pairs of nozzles which form dots that are mutually adjacent in the x direction on the paper (or a raster created by linking dots continuously in the y direction), there are nozzle pairs which are in a positional relationship separated by a distance in the y direction, in the layout of nozzles in the head (such nozzles are called a "y-offset adjacent nozzle pair" below).

In this case, if there is relative vibration in the x direction between the head and the paper, then the pitch between the rasters recorded by the y-offset adjacent nozzle pair varies depending on the relative vibration. As a result of this, a "weighting (overlapping)" or "gap" appears between the dots (adjacent dots in the x direction) which are recorded by the y-offset adjacent nozzle pair, and the extent of this "weighting" or "gap" changes in the y direction, producing a non-uniformity which degrades the image quality. In the present specification, density non-uniformity which is caused by relative vibration or displacement in the x direction between the paper and a head having a two-dimensional nozzle arrangement in this way is called "vibration non-uniformity".

A phenomenon of this kind is described here by means of the examples in FIG. 20 to FIG. 25. FIG. 20 is one example of a two-dimensional nozzle arrangement. A black dot "•" in FIG. 20 indicates a nozzle position. The horizontal axis represents a position in the x direction and the vertical axis represents a position in the y direction; a nozzle position is represented by coordinates in pixel (pix) units which are determined by the recording resolution.

As shown in FIG. 20, this two-dimensional nozzle layout has two nozzle rows separated in the y direction, and within the same row, nozzles are arranged every other 1 pix (the x-direction nozzle pitch within one row is 2 pix) and the positions of the nozzles belonging to different rows are staggered by 1 pix in the x direction with respect to each other (a so-called staggered matrix configuration). As a result of this, an image formation mode is adopted in which, a raster (scanning line) is formed on the paper every other 1 pix by the nozzle group belonging to the first row, and rasters formed by the nozzle group of the second row are embedded between the rasters formed by the nozzles of the first row. The pitch in the y direction between the first and second rows is called the offset amount of the "y-offset adjacent nozzle pair" (y-direction offset amount). Here, an example is given in which the y-direction offset amount is 500 pix. If the image formation resolution is 1200 dpi, then 500 pix is 10.6 mm.

Regarding a head having a two-dimensional nozzle arrangement as shown in FIG. 20, FIG. 21 shows one example of rasters drawn by respective nozzles in a case where there is relative vibration in the x direction between the head and paper. FIG. 21 shows a group of rasters obtained when ejection is started simultaneously from all of the nozzles and continuous ejection is performed at a prescribed droplet ejection frequency while conveying the paper at a uniform speed in the y direction. Furthermore, FIG. 22 shows an example of an image actually formed on paper in this case (a solid image; droplet ejection rate 100%). FIG. 21 and FIG. 22 are examples of a case where the single amplitude (half amplitude) of the relative vibration in the x direction is 5 μm, and the period of the relative vibration is 1000 pix=21.2 mm when converted to a spatial distance on the paper in the y direction.

In FIG. 21, the raster indicated by reference numeral 1A is drawn by nozzles belonging to the lower row (first row) in FIG. 20. In FIG. 21, the raster indicated by reference numeral 2B is drawn by nozzles belonging to the upper row (second row) in FIG. 20. The raster 1A and the raster 2B are separated by the equivalent of 500 pix in the y direction. This corresponds to the y-direction offset amount between the lower row nozzle and the upper row nozzle in FIG. 20.

If it is supposed that there is no relative vibration in the x direction between the head and the paper, then the scanning lines (rasters) of the y-offset adjacent nozzle pair are straight lines which extend in perfectly straight fashion in the y direction, and the pitch between the rasters is a uniform value determined by the resolution (for example, a pitch of about 21.2 μm in the case of 1200 dpi resolution).

On the other hand, if there is relative vibration in the x direction between the head and the paper, then the raster of a nozzle of the first row (reference numeral 1A) and the raster of a nozzle of the second row (reference numeral 2B) fluctuate respectively (see FIG. 21). This fluctuation of the rasters causes variation in the spatial period of the x-direction pitch between mutually adjacent rasters (1A, 2B), depending on the position in the paper conveyance direction (y direction).

As a result of this, as shown in FIG. 22, periodic non-uniformity occurs in the resulting image that is formed. More specifically, since the x-direction pitch between rasters which are mutually adjacent in the x direction varies periodically, then a "weighting" of the adjacent rasters (mutual approach of the rasters) and a "gap" in the adjacent rasters (distancing of the rasters) are repeated in the y direction, and this appears as a density non-uniformity in the image formation results on the paper.

In FIG. 22, a white-striped region 4 in which white stripes extending in the y direction are arranged roughly equidistantly in the x direction, and a black region 5 where the white stripes are interrupted in the y direction and appear darker (more dense) are repeated at ½ of the cycle of the vibration in the y direction (here, 500 pix).

Looking across the white-striped region 4 in the x direction, a portion where there is a white gap (white stripe) and a portion where there is no white stripe (black portion) are repeated alternately. If the white-striped portions are viewed in further detail, the gaps between white stripes (the thickness of the white stripes) are not uniform in the y direction, but rather become larger in the central portion. If the white-striped region 4 of this kind is viewed macroscopically, the density is reduced compared to the black region 5, and therefore when the image is viewed as a whole, a density non-uniformity is visible in which the density varies in the y direction (dark/light shading is repeated periodically), and therefore image quality declines.

In the description above, an example is given in which nozzles are arranged two-dimensionally in 2 rows (y direction) by N columns (x direction, where N is an integer and N≥2), but the present problem is not limited to this nozzle arrangement and a similar problem occurs in other two-dimensional nozzle arrangements (for example, an M row×N column two-dimensional nozzle arrangement, where M is an integer and M≥2).

FIG. 23 shows a case of a nozzle layout having 6 rows by N columns. Similarly to FIG. 20, if the half amplitude of the relative vibration is 5 μm, then the period of the relative vibration is 1000 pix=21.2 mm in terms of a y-direction distance on the paper. FIG. 24 shows one example of rasters in a case where there is relative vibration in the x direction between the head and the paper, in a head having the nozzle arrangement in FIG. 23, and FIG. 25 is an example of an image (solid image) formed in this case.

In the case of the nozzle arrangement shown in FIG. 23, there are a total of six combinations of nozzle rows having nozzles which constitute y-offset adjacent nozzle pairs: the first row and second row, the second row and third row, the third row and fourth row, the fourth row and fifth row, the fifth row and sixth row, and the sixth row and first row. Density non-uniformity occurs due to variation in the pitch between the rasters corresponding to these respective nozzles (see FIG. 25), and of this non-uniformity, the white stripes caused by variation in the pitch between rasters formed by the pair of nozzles which are spaced furthest apart in the y direction (namely, the nozzles of the sixth row and the nozzles of the first row) are most conspicuous and this nozzle pair which have the largest offset amount have the greatest effect on image deterioration.

In this case, as shown in FIG. 25, the white-striped region 6 and the black region 7 are repeated at a vibration period (here, 1000 pix) in the y direction. In FIG. 22 and FIG. 25, the period of the vibration non-uniformity (white-striped region and black region) varies due to the following reason.

The nozzle arrangement in FIG. 22 involves an alignment of two rows as shown in FIG. 20. In this case, there are two sets of "y-offset adjacent nozzle pairs", namely, a set of "first row nozzle-second row nozzle" (hereinafter called "A set") and a set of "second row nozzle-first row nozzle" (hereinafter called "B set"). A vibration non-uniformity having a vibration period (1000 pix) occurs in the A set nozzle pair and a vibration non-uniformity having a vibration period (1000 pix) occurs in the B set nozzle pair. Since the vibration non-uniformities created by the two sets of nozzle pairs are mutually displaced by 180 degrees in terms of the phase, then the synthesized vibration non-uniformity has a period (500 pix) of ½ of the vibration period (see FIG. 21).

On the other hand, the case shown in FIG. 25 corresponds to the nozzle arrangement indicated in FIG. 23 (a six-row arrangement), but in this case, the "y-offset adjacent nozzle pair" is formed by only one set: "sixth row nozzle-first row nozzle", and the period of the vibration non-uniformity which appears is the vibration period (1000 pix) only (see FIG. 24).

SUMMARY OF THE INVENTION

The present invention has been contrived in view of these circumstances, an object thereof being to provide an inkjet image forming apparatus and a method of designing same, and a method of improving image formation quality, whereby it is possible to reduce deterioration in image quality due to density non-uniformity (vibration non-uniformity) caused by relative vibration between a head comprising a two-dimensional nozzle arrangement and an image formation receiving medium (recording paper, or the like).

In order to achieve the aforementioned object, the following modes of the invention are offered for example.

In order to attain an object described above, one aspect of the present invention is directed to an inkjet image forming apparatus comprising: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, wherein: in a case where rotational non-uniformity can occur Nm times for each revolution of the motor (where Nm is a natural number), and when Pv represents a spatial period representing an amount of the relative movement in the first direction on the image formation receiving medium corresponding to 1/Nm revolution of the motor, and when OSy represents an offset distance in the first direction of a pair of nozzles which form dots that are mutually adjacent in a second direction perpendicular to the first direction on the image formation receiving medium, of the plurality of nozzles arranged two-dimensionally, then relationship of $OSy \approx k \times Pv$ (where k is a natural number) is satisfied.

In an inkjet image forming apparatus which performs image formation by relative scanning of a liquid ejection head and an image formation receiving medium, a periodic relative vibration may be produced in synchronism with the rotation of a motor, between the liquid ejection head and the image formation receiving medium, as a result of rotational non-uniformity in the motor which is a drive source of the scanning device. If rotational non-uniformity occurs Nm times (where Nm is a natural number) with each one revolution of the motor, then a vibration appears on the image formation receiving medium at a period (Pv) corresponding to 1/Nm revolutions of the motor. On the other hand, in a two-dimensional nozzle arrangement of a liquid ejection head, the distance between nozzles in the first direction of a nozzle pair which form dots that are mutually adjacent in the second direction on the image formation receiving medium is called the offset distance and is represented by "OSy". A nozzle pair of this kind is called a "first direction offset adjacent nozzle pair".

According to this aspect of the invention, the offset distance OSy of the first direction offset adjacent nozzle pair is generally a natural number multiple of the vibration period (Pv) on the image formation receiving medium which occurs at a period corresponding to the rotational non-uniformity of the motor, and therefore the phase of the vibration causing displacement in the second direction of the dot rows (rasters) recorded on the image formation receiving medium by the nozzle pair is generally matching. Variation in the pitch in the second direction between these dot rows (rasters) is suppressed and kept to a small amount. More specifically, variation in the pitch in the second direction between dots recorded by the nozzle pair is suppressed and vibration non-uniformity is reduced.

If $OSy = k \times Pv$ is satisfied, then it is possible to suppress vibration non-uniformity more favorably, but a suitable effect can be obtained even if OSy/Pv diverges slightly from k (where k is a natural number). The nearer the value of OSy/Pv to a natural number, the greater the effect in suppressing vibration non-uniformity, whereas the greater the difference between OSy/Pv and a natural number k, the smaller the effect in suppressing vibration non-uniformity.

The scanning device may employ a mode where an image formation receiving medium is conveyed with respect to a stationary liquid ejection head, a mode where a liquid ejection head is moved with respect to a stationary image formation receiving medium, or a mode where both the liquid ejection head and the image formation receiving medium are moved.

Depending on the mode of the two-dimensional nozzle arrangement, there are nozzle pairs having different offset distances, amongst the first direction offset adjacent nozzle pairs, but the present invention does not require the aforementioned relationship to be established in respect of all of the nozzle pairs and a suitable effect in reducing non-uniformity is obtained provided that the aforementioned relationship is satisfied in respect of a portion of the nozzle pairs which have a large effect of vibration non-uniformity.

Desirably, the relationship of $|\sin\{\pi \cdot OSy/Pv\}| \leq 1/4$ is satisfied.

As stated above, the effect in suppressing vibration non-uniformity varies depending on the value of OSy/Pv. By satisfying the relationship above, a large effect in reducing vibration non-uniformity is obtained since the half amplitude of the pitch variation of the pitch between dot rows (rasters) that are adjacent in the second direction on the image formation receiving medium can be suppressed to not greater than ½ of the half amplitude Av in the second direction of the relative vibration which occurs with a period corresponding to the pitch of the meshing teeth.

Desirably, a group of the plurality of nozzles arranged two-dimensionally includes the pairs of nozzles having the different offset distances, and the relationship is satisfied, with a maximum value of the different offset distances being taken as OSy.

The greater the offset distance, the greater the effect on vibration non-uniformity, and therefore if at least the maximum value of the offset distance is taken as the value of OSy, then desirably the relationship $OSy \approx k \times Pv$ or the relationship $|\sin(\pi \cdot OSy/Pv)| \leq 1/4$ is satisfied.

It is possible that the liquid ejection head is formed by joining together a plurality of head modules each of which has an ejection surface in which a plurality of nozzles are arranged two-dimensionally; and when the offset distance of the pair of nozzles which spans different head modules of the plurality of head modules is represented by OSy_B, the relationship is satisfied by taking OSy_B as OSy.

According to this aspect of the invention, in a mode where one liquid ejection head (head bar) is composed by joining together a plurality of head modules, it is possible to reduce vibration non-uniformity in first direction offset adjacent nozzles pairs which span different modules. This aspect of the invention is especially useful in a composition where head modules are arranged two-dimensionally.

The plurality of head modules may be disposed in a staggered arrangement.

Desirably, the scanning device includes a medium conveyance device which conveys the image formation receiving medium, and the medium conveyance device employs a drum rotation system which holds the image formation receiving medium on a cylindrical surface of a drum and rotates the drum.

Desirably, when a diameter of the drum is represented by Ddr and a speed reduction ratio of the drive force transmission mechanism is represented by R, then Pv which indicates a period of vibration appearing on the image formation receiving medium as a result of rotation of the motor is expressed by $Pv = \pi \cdot Ddr \cdot R/Nm$.

The inkjet image forming apparatus may carry out image formation based on a single pass method such that the relative movement between the image formation receiving medium and the liquid ejection head is caused just once in the first direction by the scanning device to form an image on the image formation receiving medium.

Vibration non-uniformity is a particular problem in a single pass method, and therefore it is effective that this aspect of the present invention is applied to such cases. According to this aspect of the present invention, it is possible to achieve both high image formation quality and high productivity.

In order to attain an object described above, another aspect of the present invention is directed to a method of designing an inkjet image forming apparatus including: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, wherein: in a case where rotational non-uniformity can occur Nm times for each revolution of the motor (where Nm is a natural number), and when Pv represents a spatial period representing an amount of the relative movement in the first direction on the image formation receiving medium corresponding to 1/Nm revolution of the motor, and when OSy represents an offset distance in the first direction of a pair of nozzles which form dots that are mutually adjacent in a second direction perpendicular to the first direction on the image formation receiving medium, of the plurality of nozzles arranged two-dimensionally, then arrangement of the plurality of nozzles in the liquid ejection head and a speed reduction ratio of the drive force transmission mechanism are specified in such a manner that relationship of $OSy \approx k \times Pv$ (where k is a natural number) is satisfied.

According to this aspect of the invention, when designing an inkjet image forming apparatus, particular attention is paid to the relationship between the nozzle arrangement in the liquid ejection head (and in particular, the offset distance of the first direction offset adjacent nozzle pairs) and the speed reduction ratio of the drive force transmission mechanism, and the dimensions are adjusted and the members are selected, and the like, so as to satisfy the relationship: $OSy \approx k \times Pv$ (where k is a natural number). By this means, it is possible to manufacture an inkjet image forming apparatus in which vibration non-uniformity is reduced.

For example, it is possible to create a design which optimizes the speed reduction ratio of the speed reducing system with respect to a certain given nozzle arrangement. Conversely, it is also possible to create a design which optimizes the nozzle arrangement with respect to a drive force transmission mechanism having a certain given speed reduction ratio.

In order to attain an object described above, another aspect of the present invention is directed to a method of improving image formation quality of an inkjet image forming apparatus including: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, the method comprising the steps of: obtaining information indicating, in a case where rotational non-uniformity can occur Nm times for each revolution of the motor (where Nm is a natural number), a spatial period representing an amount of the relative movement in the first direction on the image formation receiving medium corresponding to 1/Nm revolution of the motor; acquiring information indicating an offset distance in the first direction of a pair of nozzles which form dots that are mutually adjacent in a second direction perpendicular to the first direction on the image formation receiving medium, of the plurality of nozzles arranged two-dimensionally; and modifying a speed reduction ratio of the drive force transmission mechanism in such a manner that relationship of $OSy \approx k \times Pv$ (where k is a natural number, Pv represents the obtained spatial period and OSy represents the acquired offset distance) is satisfied.

In general, there is little scope for modification in the design of a nozzle arrangement, and in many cases it is easier to change the components or the design of the drive force transmission system. Furthermore, a liquid ejection head is highly expensive compared to gear wheels and other components of a drive force transmission system. Consequently, according to this aspect of the invention, it is possible to improve the effects of vibration non-uniformity in a relatively simple fashion and at low cost, and it is possible to obtain an inkjet image forming apparatus which achieves good image formation quality. The sequence of a first step (step of obtaining information indicating the spatial period) and a second step (step of acquiring information indicating the offset distance) is not limited, and either of the steps can be carried out first.

According to the present invention, it is possible to satisfactorily reduce non-uniformity (vibration non-uniformity) appearing on an image formation receiving medium caused by a two-dimensional nozzle arrangement and rotational non-uniformity of a motor when performing relative scanning of a liquid ejection head and the image formation receiving medium. By this means, it is possible to achieve high image formation quality and high productivity.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Principle of Suppressing Vibration Non-Uniformity According to Embodiments of the Invention Firstly, the causes of vibration non-uniformity and the corresponding principles of embodiments of the present invention will be described. In the following description, the paper conveyance direction (y direction) corresponds to the "first direction" and the x direction perpendicular to this corresponds to the "second direction".

(1) Causes of Vibration Non-Uniformity

There are following two main causes of vibration non-uniformity.

(1-a) Causes of x Direction Relative Vibration (Main Cause)

In an inkjet image forming apparatus, a motor is used as a source of drive force for a device which causes relative movement of the head and the paper. For example, in the case of an inkjet image forming apparatus based on a drum conveyance method, the rotation of the motor is transmitted to a drum via a drive force transmission system, such as a belt, pulley or gear wheels of various kinds, thus forming a composition which causes the drum to rotate. The ratio of the speed of revolution between the motor and the drum is determined by the gear reduction ratio of the drive force transmission system between the motor and the drum.

Generally, a motor has rotational non-uniformity which is synchronous with one revolution. The "rotational non-uniformity" referred to here can be regarded as harmonic non-uniformity, such as non-uniformity which occurs once during one revolution caused by the mechanical system of the motor (for example, if the output shaft of the motor is eccentric with respect to the center of rotation), or non-uniformity which occurs twice in one revolution (for example, if the cross-section of the output shaft of the motor is oval-shaped), or non-uniformity which occurs three times in one revolution due to the structure of the motor (for example, a three-phase motor). The order of this (the number of times that non-uniformity occurs in one revolution of the motor) is represented by Nm (a natural number). This rotational non-uniformity is transmitted to the drum via the drive force transmission system, and consequently appears as vibration having a uniform period on the paper (x-direction vibration, y-direction vibration). The vibration in the x-direction of the drum is especially large if using a helical gear wheel as a gear wheel.

The period Pv of the vibration appearing on the paper is determined by the gear reduction ratio R and the drum diameter Ddr, and is expressed by the following Formula.

$$Pv=\pi\cdot Ddr\ R/Nm\ (Nm\text{:natural number}) \qquad \text{Formula 1}$$

Here, the symbol "·" in the Formulae represents the multiplication operator (×).

Figure 1:
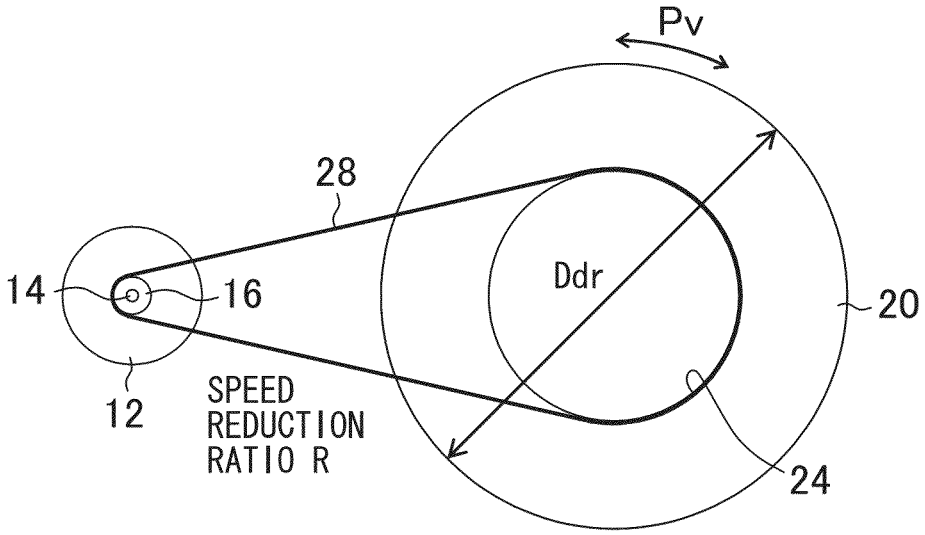
FIG. 1 is an illustrative diagram showing an example of a drive force transmission mechanism between a motor and a drum.

The calculation based on Formula 1 is described here briefly with reference to FIG. 1. The rotation transmission mechanism shown in FIG. 1 has a structure in which an endless toothed belt 28 is wound between a pulley 16 which is fixed to a shaft 14 of a motor 12 and a pulley 24 which is coupled directly to a drum 20. If the speed reduction ratio in this transmission mechanism is represented by R (for example, R=1/10), then the drum 20 performs R revolutions with each revolution of the motor. Since the circumferential length of the drum 20 is "π×Ddr", then the amount of movement (in the circumferential direction) of the circumferential surface of the drum for each revolution of the motor is "π×Ddr×R". Since rotational non-uniformity (relative vibration) occurs Nm times with each revolution of the motor, then the vibration period Pv on the circumferential surface of the drum (the spatial period in the circumferential direction of the drum) is a value of (π×Ddr×R/Nm) derived from dividing "π×Ddr×R" by Nm.

(1-b) Relationship Between x-Direction Vibration Period and Nozzle Arrangement (Secondary Cause)

The extent of the x-direction pitch variation ΔD(y) between two scanning lines (rasters) recorded by a "y-offset adjacent nozzle pair" changes depending on the relationship between the y-direction offset amount (which is equivalent to the "offset distance") OSy of the "y-offset adjacent nozzle pair" arising from the nozzle arrangement in the head, and the period Pv of the x-direction relative vibration on the paper (Pv being obtained by converting the period of rotation non-uniformity of the motor to a spatial period in the y direction on the paper).

Figure 2:
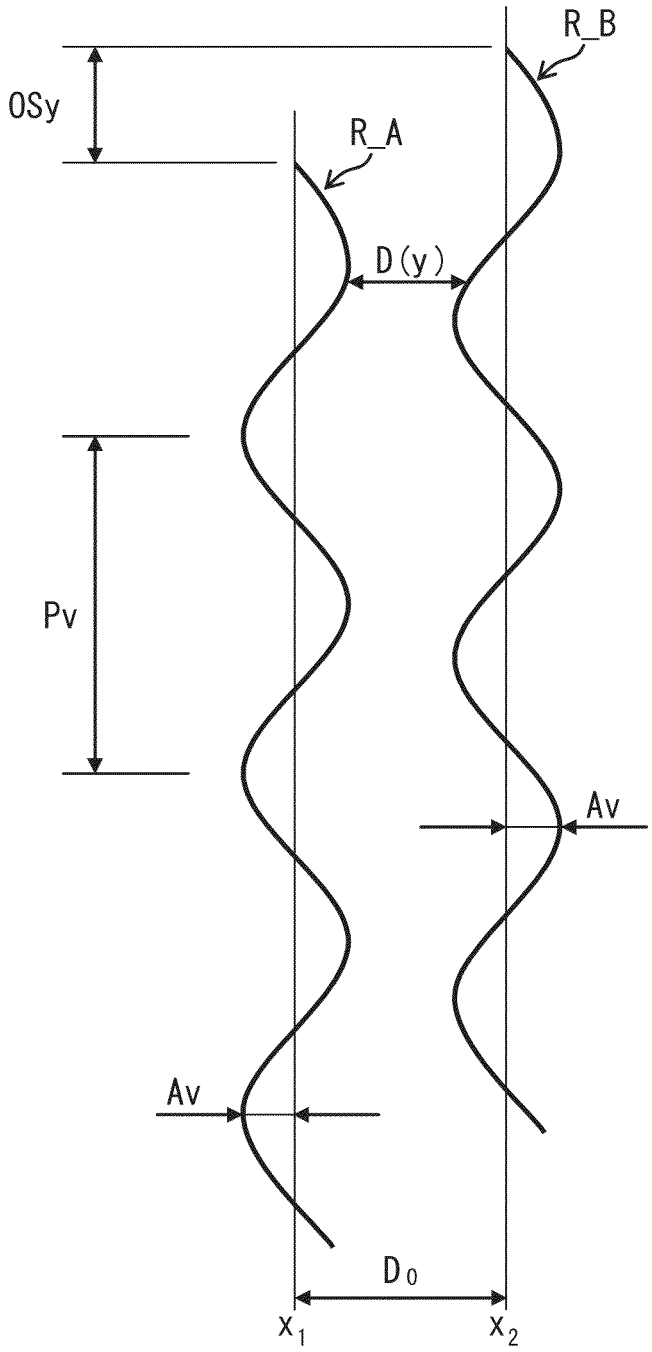
FIG. 2 is an illustrative diagram showing a schematic view of rasters in a paper conveyance direction which are recorded by a y-offset adjacent nozzle pair.

FIG. 2 shows an enlarged schematic view of rasters (scanning lines) in the paper conveyance direction which are recorded by a y-offset adjacent nozzle pair. For the sake of simplicity, in the illustration in FIG. 2, the longitudinal/lateral dimensional ratio is distorted (deformed) in order to emphasize the amount of fluctuation of the rasters.

The horizontal direction in FIG. 2 corresponds to the lengthwise direction of the long inkjet head (bar) (called the "x direction"), and the vertical direction corresponds to the paper conveyance direction (direction of relative movement of the head and the paper, called the "y direction"). The line R_A having the waveform shown on the left-hand side in FIG. 2 indicates a raster produced by one nozzle of a y-offset adjacent nozzle pair (called "nozzle A" here), and the line R_B having the waveform shown on the right-hand side of FIG. 2 indicates a raster produced by the other nozzle of the pair (called "nozzle B" here). Rasters are recorded by dot rows created by a continuous sequence of dots formed by liquid droplets which are deposited on paper by performing continuous droplet ejection at a uniform cycle (ejection frequency) from the nozzles A and B while conveying the paper at a uniform speed in the y direction. The ejection frequency and the paper conveyance speed are specified on the basis of the image formation resolution in the y direction, and the x-direction distance between the nozzles A and B is specified on the basis of the image formation resolution in the x direction.

As FIG. 2 reveals, the raster pitch D(y) between the rasters of the y-offset adjacent nozzle pair changes with the relative vibration between the head and the paper. The amount of change (variation) ΔD(y) in this pitch D(y) is expressed as shown below in terms of the y-direction offset amount OSy, the relative vibration period Pv, and the (half) amplitude of the relative vibration in the x direction, Av.

$$\Delta D(y) = Av \cdot [\sin\{\theta(y)\} - \sin\{\theta(y) + 2\pi \cdot OSy/Pv\}] \quad \text{Formula 2}$$

$$= 2 \cdot Av \cdot \sin\{-\pi \cdot OSy/Pv\} \cdot \cos\{\theta(y) + \pi \cdot OSy/Pv\}$$

Furthermore, the maximum value ΔDmax of the raster pitch variation is expressed as follows on the basis of Formula 2.

$$\Delta D\max = \max|\Delta D(y)| = 2 \cdot Av \cdot |\sin\{\pi \cdot OSy/Pv\}| \quad \text{Formula 3}$$

In Formula 2 and Formula 3, the multiplication symbol (×) is written as "·". Here, ΔDmax is the amplitude of the raster pitch variation, and the value thereof is determined by Av, OSy and Pv. In other words, ΔDmax is a constant component with respect to y (a value which is independent of y). On the other hand, the element "cos {θ(y)+π·OSy/Pv}" in Formula 2 is a variable component which varies with y.

Calculation of Formula 2

If there is relative variation between the paper and the head, then the rasters drawn on the paper by a y-offset adjacent nozzle pair in the head fluctuate (undulate) with the period of that relative variation. As a result of this, as shown in FIG. 2, the x-direction pitch D(y) between the rasters varies depending on the position y in the paper conveyance direction (as a function of y).

The position (x-direction position) of the raster recorded by one nozzle A of the y-offset adjacent nozzle pair under consideration varies with a half amplitude Av about the ideal position (reference position $x_1$), and therefore this vibration is represented by a triangular function, and when the phase component of the vibration is represented by θ(y), the amount of variation $\Delta X_A$ in the position $X_A$ of the raster produced by the nozzle A is expressed as follows as a function of y.

$$\Delta X_A = X_A(y) - x_1 = Av \sin\{\theta(y)\} \quad \text{Formula 4}$$

Similarly, the position of the raster (x direction position) recorded by the other nozzle B of the y-offset adjacent nozzle pair under consideration varies with a half amplitude Av about the ideal position (reference position $x_2$), and furthermore since there is an initial phase difference (2π·OSy/Pv) corresponding to the y-direction offset amount OSy between the nozzle A and the nozzle B, then the amount of variation $\Delta X_B$ of the position of the raster $X_B$ produced by nozzle B is expressed as follows as a function of y.

$$\Delta X_B = X_B(y) - x_2 = \sin\{\theta(y) + 2\pi \cdot OSy/Pv\} \quad \text{Formula 5}$$

Therefore, the amount of variation, ΔD(y), in the x-direction pitch between the rasters formed by the "y-offset adjacent nozzle pair" constituted by the nozzle A and nozzle B can be expressed as a difference between the raster variation of nozzle A ($\Delta X_A$) and the raster variation of nozzle B ($\Delta X_B$), and is represented by Formula 2. The formula can be modified by using a product sum formula derived from an addition theorem. Furthermore, in the y-offset adjacent nozzle pair, it is not a fundamental issue which of the nozzles is designated as nozzle A or nozzle B, and a similar theory is established if the relationship between the nozzles is reversed.

Figure 3:
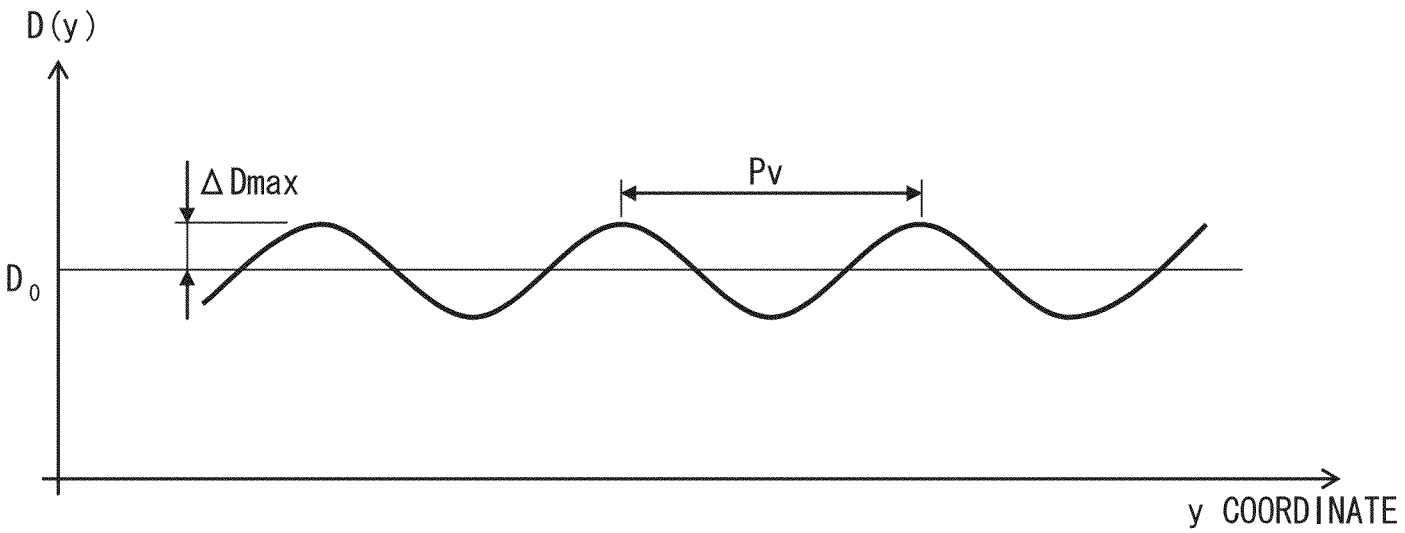
FIG. 3 is a graph showing an example of a state where the raster pitch D(y) of the y-offset adjacent nozzle pair varies.

FIG. 3 is a graph showing an example of a state where the raster pitch D(y) of the y-offset adjacent nozzle pair varies. The horizontal axis indicates the position on the paper in the y direction (y coordinate) and the vertical axis indicates the raster pitch D(y). If there is no relative vibration in the x direction between the head and the paper, then the ideal raster pitch is a specified value $D_0$ which is determined by the image formation resolution. For example, if the resolution is 1200 dpi, then $D_0$=1 pix=21.2 μm. However, if there is relative vibration in the x direction (vibration period Pv) between the head and the paper, then as shown in FIG. 3, the raster pitch D(y) varies with an amplitude of ΔDmax and a relative vibration period of Pv.

As stated in Formula 3, ΔDmax is a value specified by the relationship between OSy and Pv, and ΔDmax can take a value in the range of 0≤ΔDmax≤2Av, depending on the ratio between OSy and Pv (OSy/Pv).

Table 1 shows the relationship between the amplitude of the raster pitch variation, ΔDmax, and the vibration non-uniformity in a case where specific conditions are established between the offset amount OSy of the y-offset adjacent nozzle pair and the period Pv of the relative vibration in the x direction. In Table 1, k represents zero or a positive integer.

TABLE 1

| Condition | OSy/Pv | π · OSy/Pv | sin{π · OSy/Pv] | ΔDmax | Vibration Non-Uniformity |
|---|---|---|---|---|---|
| [1] | k | k · π | 0 | 0 | Best or None |
| [2] | k + 1/2 | (k + 1/2) · π | ±1 | 2 · Av | Worst |

Figure 4A:
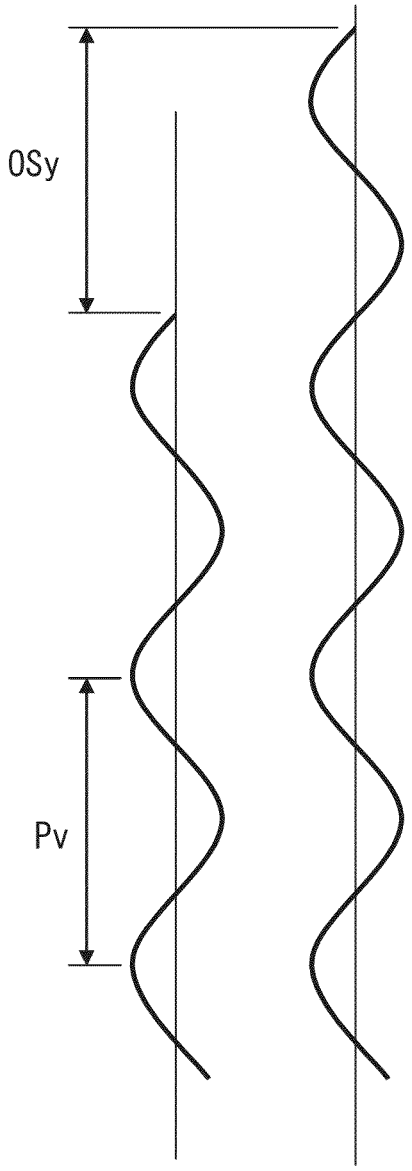
FIGS. 4A and 4B are illustrative diagrams showing an example of the relationship between the offset amount of a nozzle pair (OSy), the conditions of the relative vibration period (Pv) and the pitch variation between rasters.

Condition [1] in Table 1 corresponds to a practical example of the present invention, and indicates the best condition yielding the minimum effect of relative vibration, since the offset amount OSy of the y-offset adjacent nozzle pair is an integral multiple of the vibration period Pv of the x-direction relative vibration (the phases of the variation of the two rasters which are mutually adjacent in the x direction are matching) (see FIG. 4A).

Figure 4B:
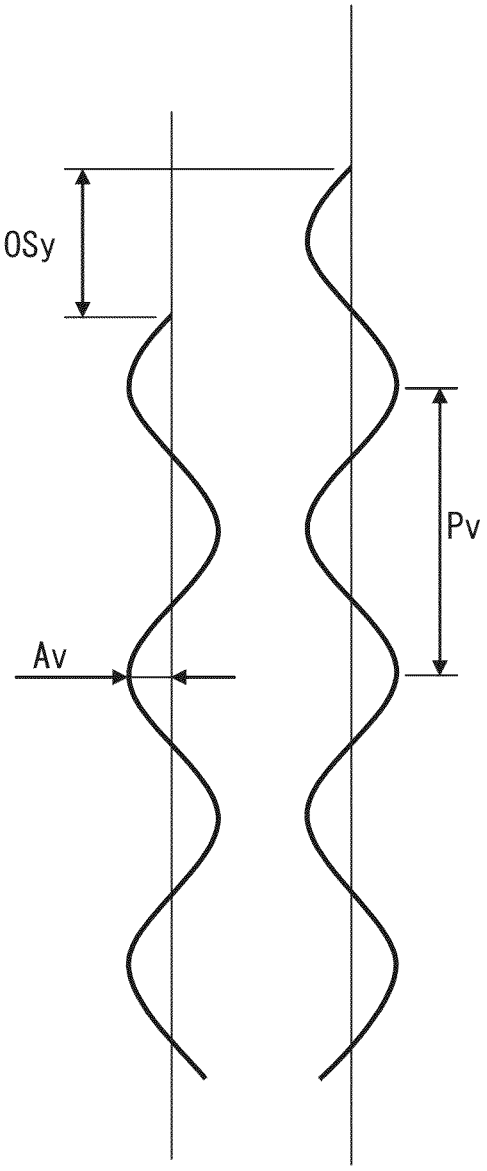

On the other hand, the condition [2] indicated in the bottom part of Table 1 corresponds to a comparative example, and since the offset amount OSy of the y-offset adjacent nozzle pair is (k+½) times the vibration period Pv of the x-direction relative vibration, then the phase angle of the variation is displaced by precisely π between the rasters which are mutually adjacent in the x direction. Therefore, the amplitude ΔDmax (half amplitude) of the variation between rasters is twice the amplitude (half amplitude) of the relative vibration Av (see FIG. 4B). In this case, the effects of the relative vibration are emphasized most strongly, and hence the worst conditions are obtained in which vibration non-uniformity is highly conspicuous on the paper.

Figure 5:
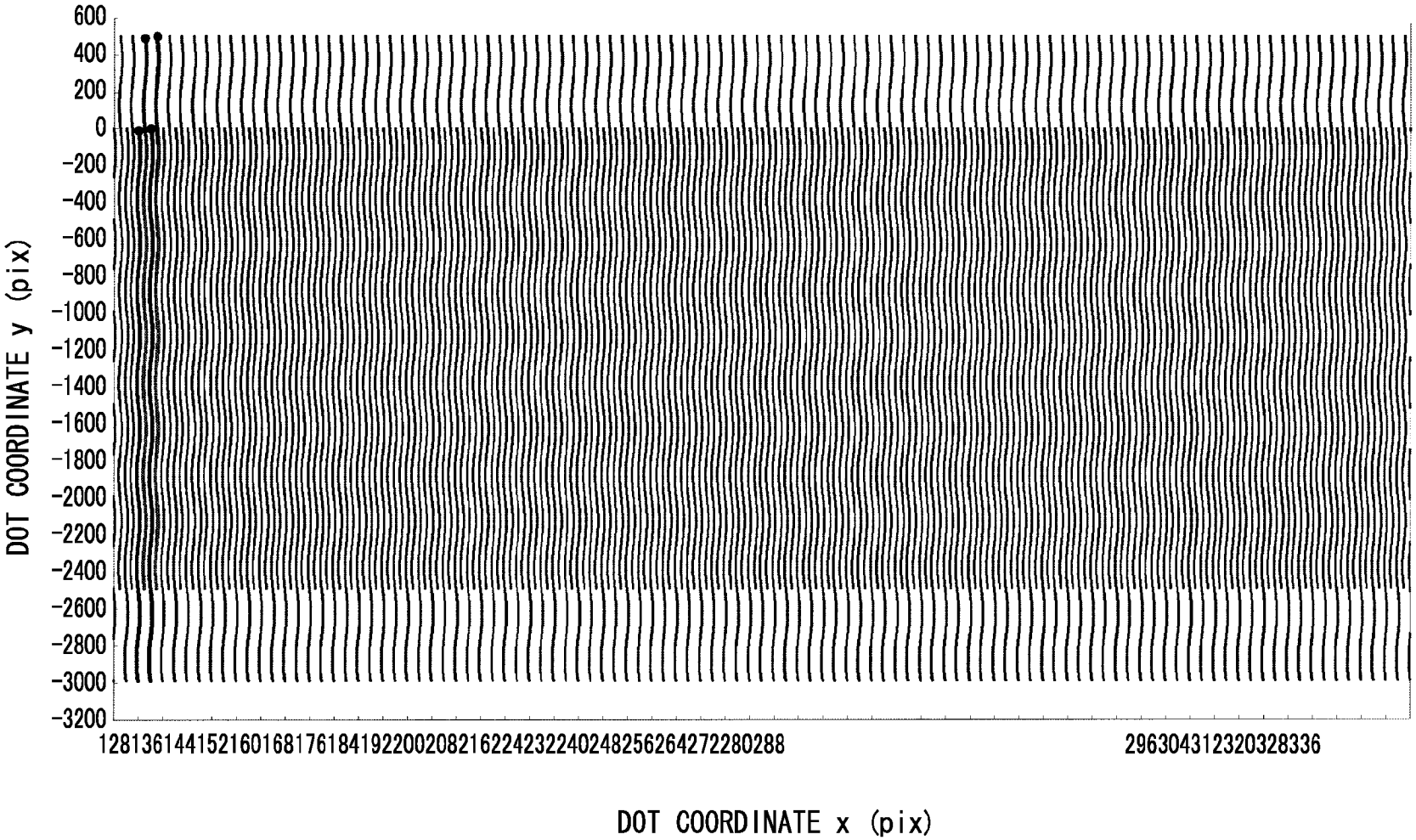
FIG. 5 is a diagram showing an example of rasters obtained by applying an embodiment of the present invention to a head having a two-dimensional nozzle arrangement in 2 rows and N columns.
Figure 6:
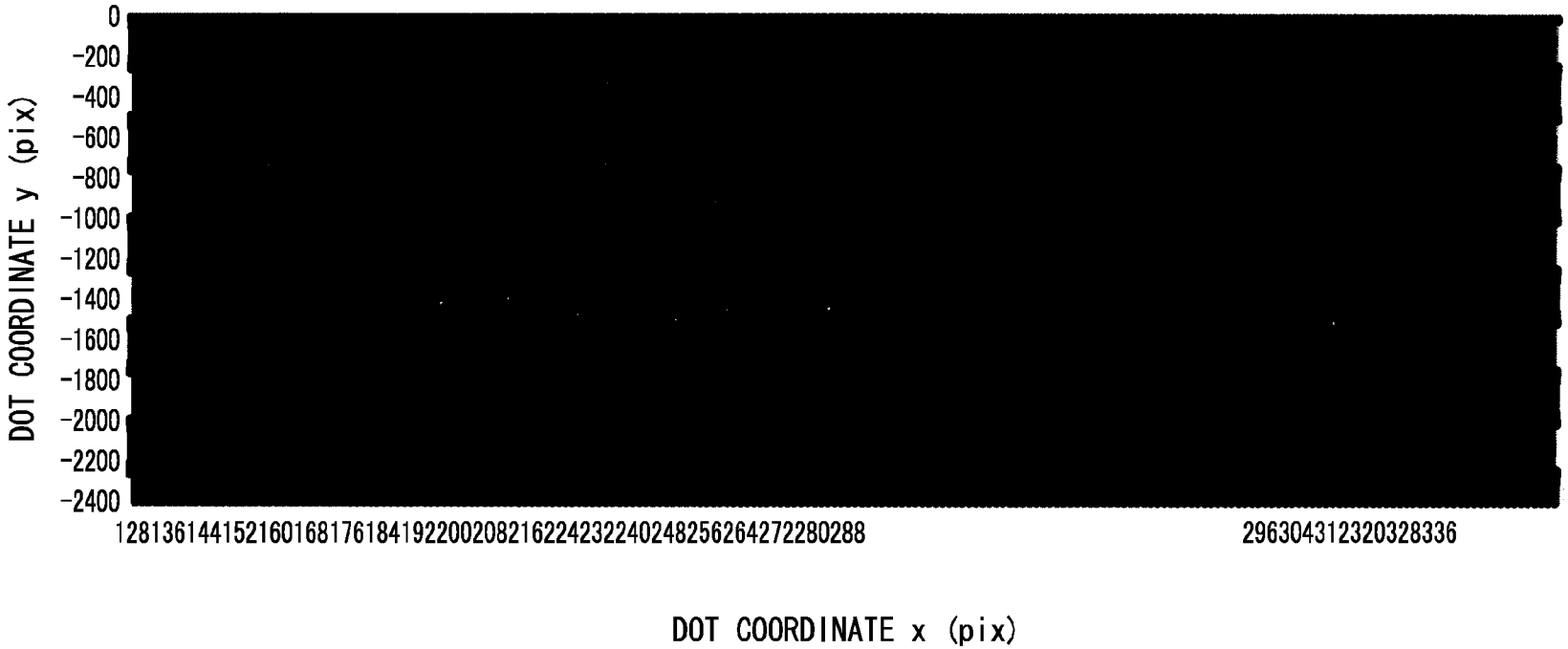
FIG. 6 is a diagram showing an example of an image (solid image) formed under the conditions shown in FIG. 5.
Figure 20:
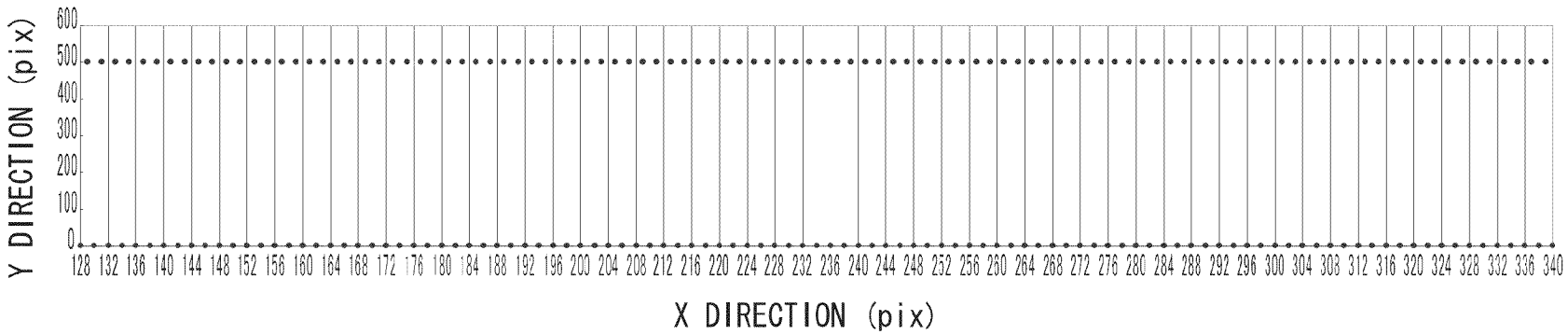
FIG.20 RELATED ART
FIG. 20 is a nozzle layout diagram showing an example of a two-dimensional nozzle arrangement comprising 2 rows×N columns.
Figure 21:
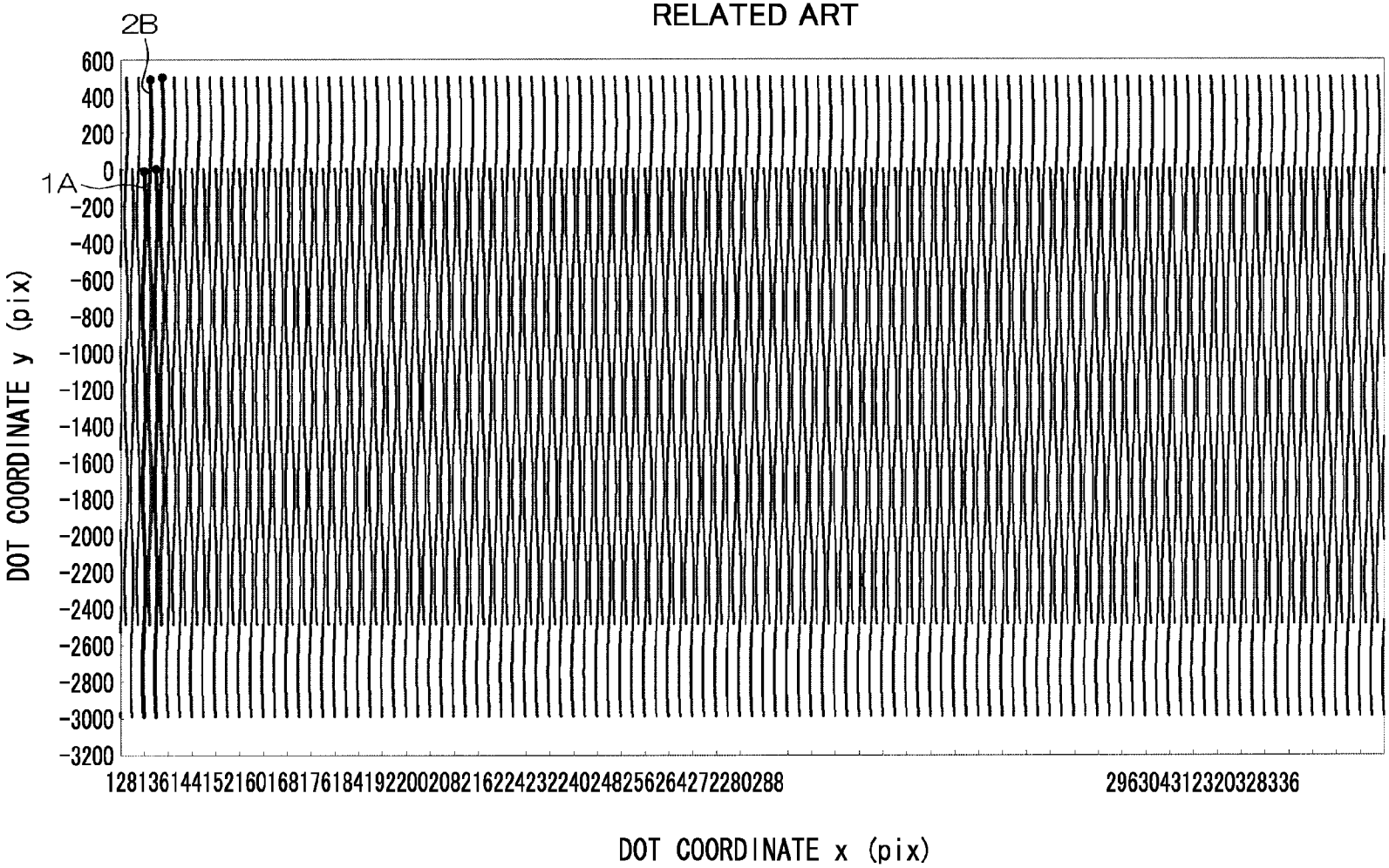
FIG.21 RELATED ART
FIG. 21 is a diagram showing rasters obtained by an inkjet image forming apparatus which uses the nozzle arrangement in FIG. 20.
Figure 22:
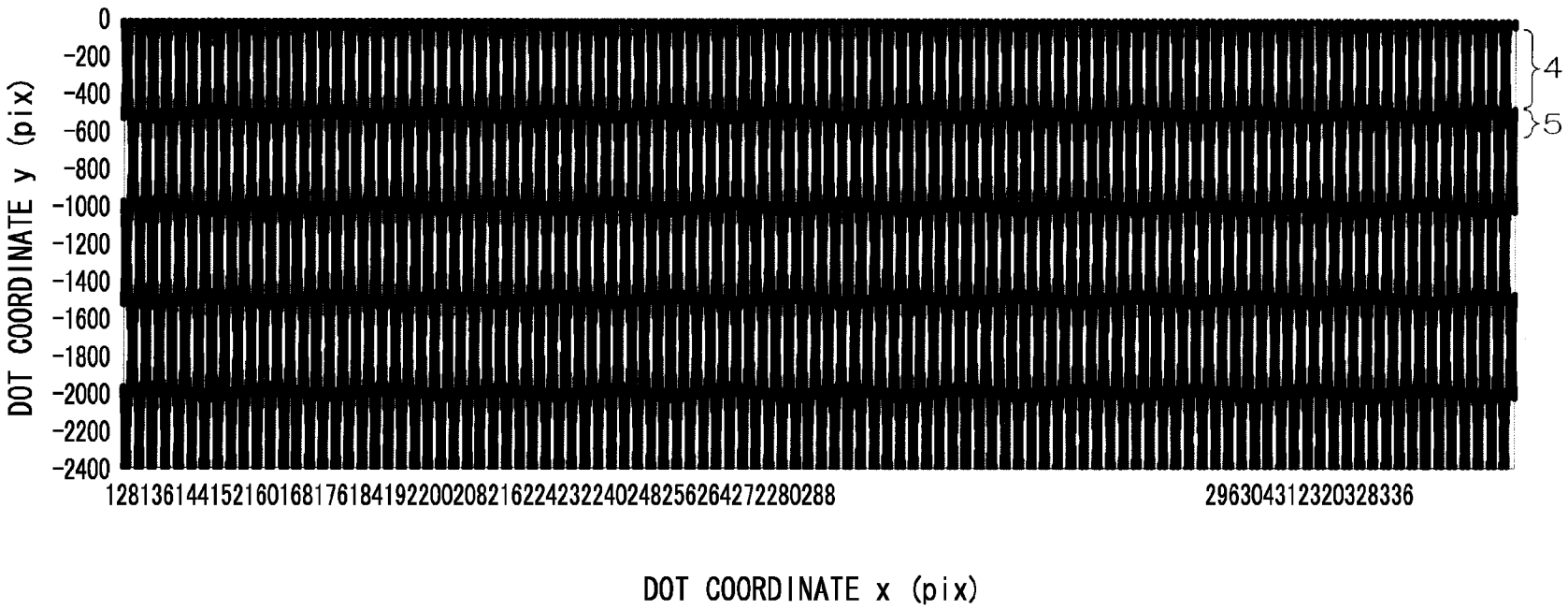
FIG.22 RELATED ART
FIG. 22 is a diagram showing an example of an image (solid image) formed under the conditions shown in FIG. 21.

The examples shown in FIG. 21 and FIG. 22 correspond to condition [2] in Table 1. FIGS. 5 and 6 show the examples of image formation results in a case where the relationship between the relative vibration period Pv and the offset amount OSy corresponds to condition [1] in Table 1 relating to a nozzle arrangement of 2 rows×N columns shown in FIG. 20.

Figure 7:
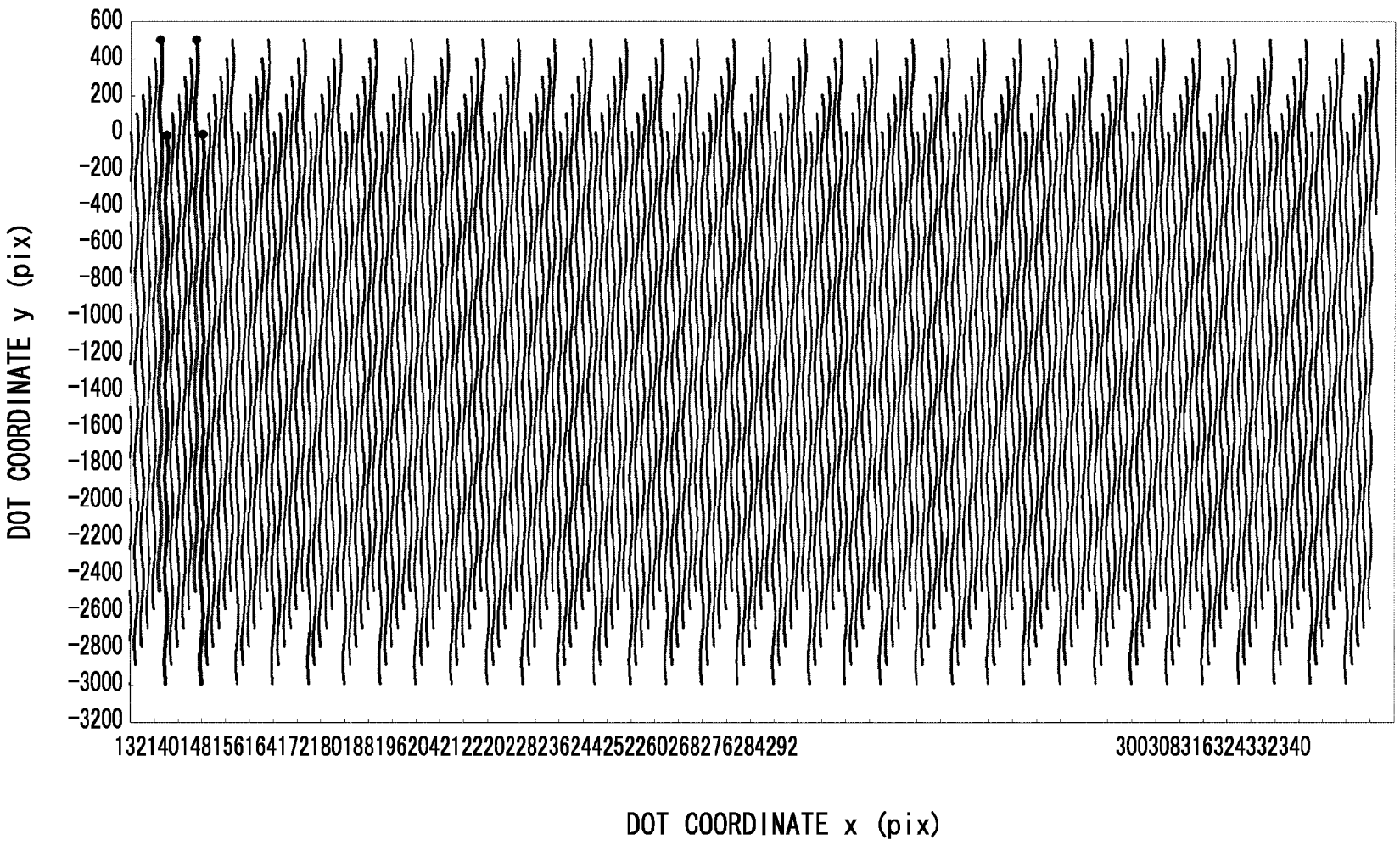
FIG. 7 is a diagram showing an example of rasters obtained by applying an embodiment of the present invention to a head having a two-dimensional nozzle arrangement in 6 rows and N columns.
Figure 8:
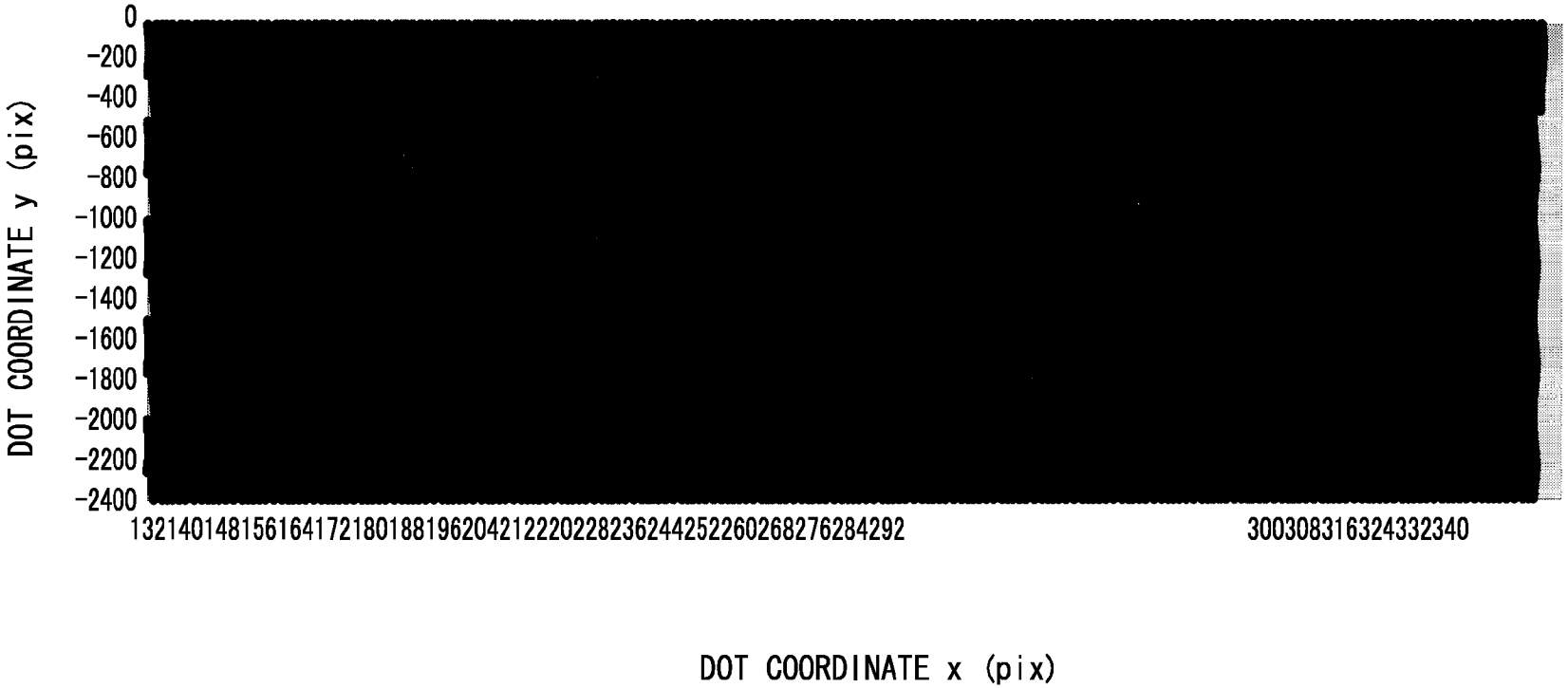
FIG. 8 is a diagram showing an example of an image (solid image) formed under the conditions shown in FIG. 7.
Figure 23:
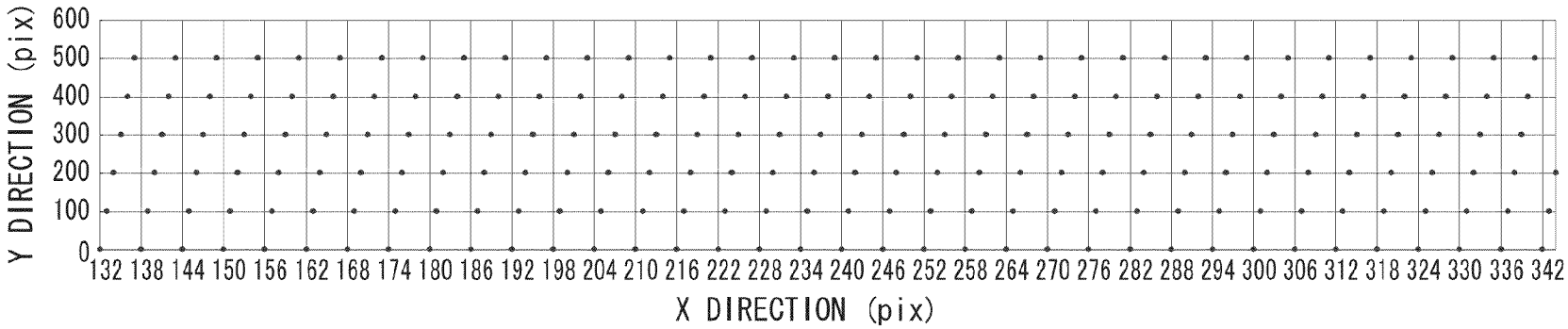
FIG.23 RELATED ART
FIG. 23 is a nozzle layout diagram showing an example of a two-dimensional nozzle arrangement comprising 6 rows×N columns.
Figure 24:
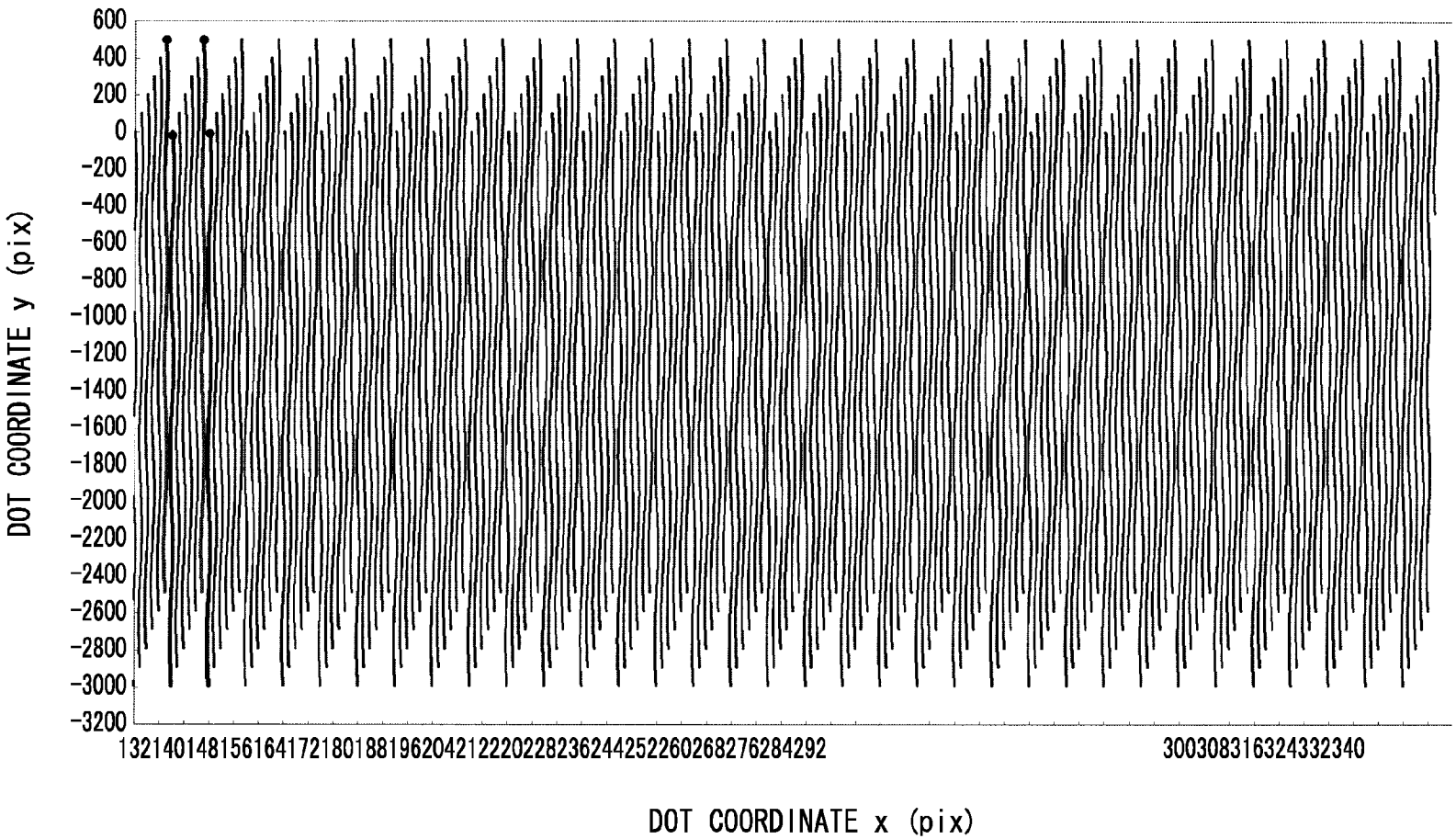
FIG.24 RELATED ART
FIG. 24 is a diagram showing rasters obtained by an inkjet image forming apparatus which uses the nozzle arrangement in FIG. 23.
Figure 25:
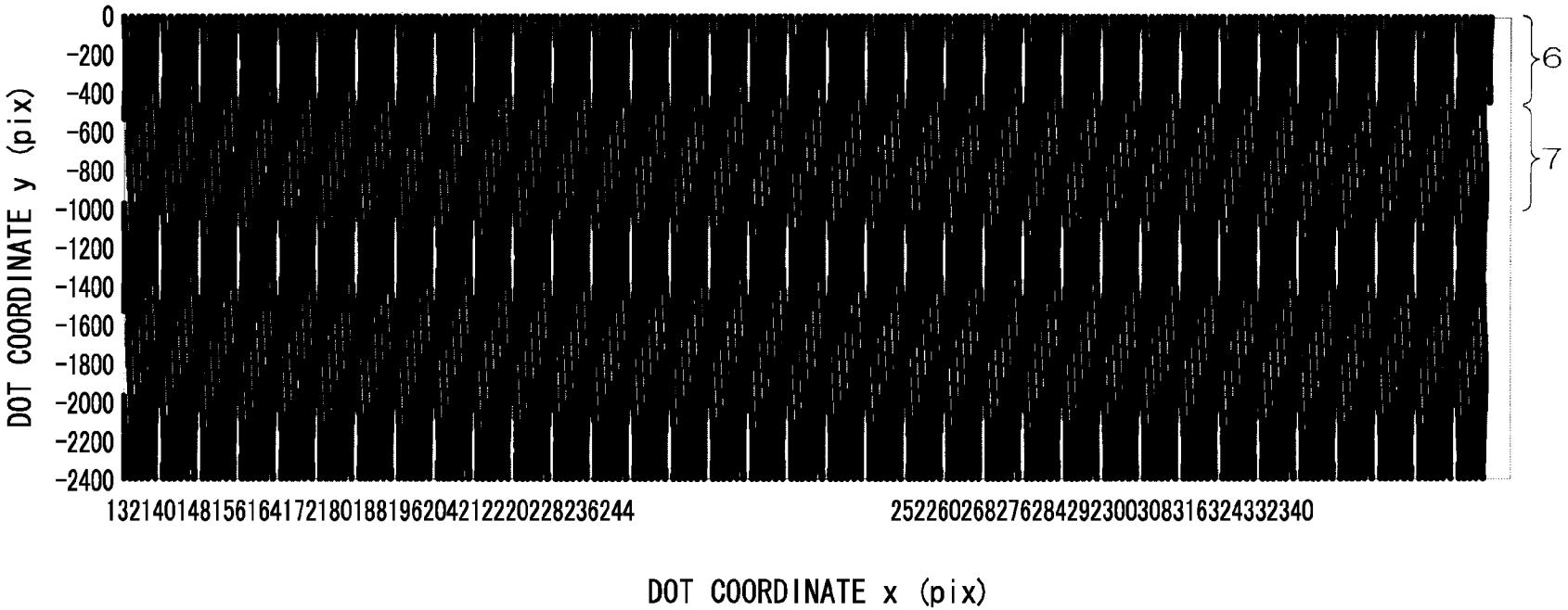
FIG.25 RELATED ART
FIG. 25 is a diagram showing an example of an image (solid image) formed under the conditions shown in FIG. 24.

Furthermore, FIG. 7 and FIG. 8 show image formation results in a case corresponding to condition [1] in Table 1, for a nozzle arrangement of 6 rows×N columns shown in FIG. 23 (FIG. 24 and FIG. 25 correspond to condition [2] in Table 1).

In FIG. 6 and FIG. 8 which correspond to the favorable condition [1], it can be seen that the vibration non-uniformity which appears in FIG. 22 and FIG. 25 is reduced. For the purpose of comparison, the half amplitude of the relative vibration is the same value of 5 μm here, and the period of the relative vibration is 500 pix=10.6 mm.

(2) Method of Resolving Vibration Non-Uniformity

There are limitations on the extent to which the amount of vibration of the sources of vibration which are principal causes of the vibration non-uniformity can be reduced, because of the system/configuration of the motor. Therefore, vibration non-uniformity is reduced by optimizing the relationship between the vibration period and the nozzle arrangement which is a subsidiary cause. More specifically, the apparatus is composed in such a manner that the relationship between the vibration period Pv on the paper corresponding to the period of rotation non-uniformity of the motor (for example, $Pv=\pi \cdot Ddr \cdot R/Nm$ of Formula 1) and the offset amount OSy of the "y-offset adjacent nozzle pair" which is determined by the nozzle arrangement in the head assumes the condition [1] in Table 1 or a condition approximating same.

In other words, the apparatus is composed in such a manner that the relationship in Relationship 1 below is satisfied.

$$OSy \approx k \times Pv \text{ (where } k \text{ is a natural number)} \qquad \text{Relationship 1}$$

The vibration period Pv can also be expressed by a period on the paper corresponding to 1/Nm revolutions of the motor (where Nm is a natural number).

From Formula 3, ΔDmax can take a value from 0 to 2Av. The extent of the effect in reducing non-uniformity varies depending on the value of ΔDmax, and the smaller the value of ΔDmax, the greater the extent to which deterioration of the image quality caused by non-uniformity is suppressed. Considering the fact that the x-direction amplitude of the relative vibration produced at the period corresponding to 1/Nm revolutions of the motor is Av, then from the viewpoint of obtaining an effect in reducing vibration non-uniformity to a desirable and practicable level, preferably, ΔDmax is not greater than Av/2 and more desirably, not greater than Av/4.

In other words, from Formula 3, it is desirable to satisfy Relationship 2 below.

$$|\sin\{\pi \cdot OSy/Pv\}| \leq 1/4 \qquad \text{Relationship 2}$$

More desirably, Relationship 3 indicated below is satisfied.

$$|\sin\{\pi \cdot OSy/Pv\}| \leq 1/8 \qquad \text{Relationship 3}$$

In the case of the nozzle arrangement of 2 rows by N columns illustrated in FIG. 20, the offset amount OSy of the y-offset adjacent nozzle pair is a uniform value, but there are also cases where the offset amount of the y-offset adjacent nozzle pair is a different value, as in the nozzle arrangement of 6 rows by N columns shown in FIG. 23. In other words, the offset amount between the nozzles of the first row (bottommost row) and the nozzles of the second row is 100 pix, and the offset amounts between the second row and the third row, the third row and the fourth row, and the fourth row and the fifth row are respectively 100 pix, but the offset amount between the sixth row and the first row is 500 pix.

If there are y-offset adjacent nozzle pairs which have different offset amounts in this way, then it is not absolutely necessary to adopt a composition which satisfies Relationship 1, Relationship 2 or Relationship 3 in respect of all of the different offset amounts. The greater the offset amount of the nozzle pair, the greater their effect on vibration non-uniformity, and therefore a suitable effect is obtained provided that a composition is adopted whereby Relationship 1, 2, or 3 is satisfied in respect of the maximum value of the offset amount at least. In actual practice, in the case of the nozzle arrangement in FIG. 23, a sufficient effect in improving image quality is observed if the Relationship 1, 2 or 3 is satisfied by taking OSy to be the offset amount (=500 pix) of the nozzle pair constituted by a nozzle of the first row (bottommost row) and a nozzle of the sixth row (uppermost row) which form adjacent dots in the x direction.

Example of Composition of Inkjet Image Forming Apparatus

Figure 9:
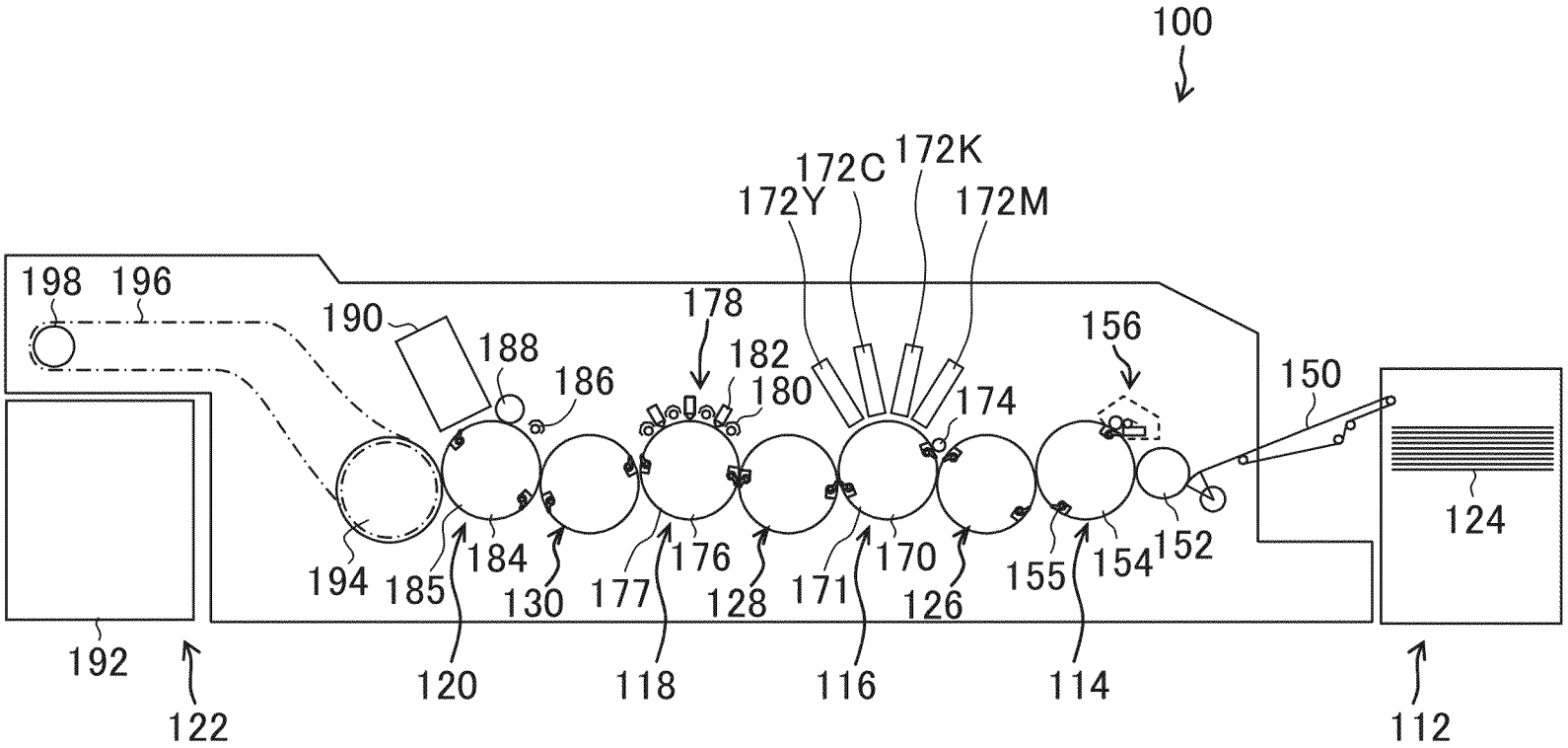
FIG. 9 is a general schematic drawing of an inkjet image forming apparatus relating to an embodiment of the present invention.
Figure 10:
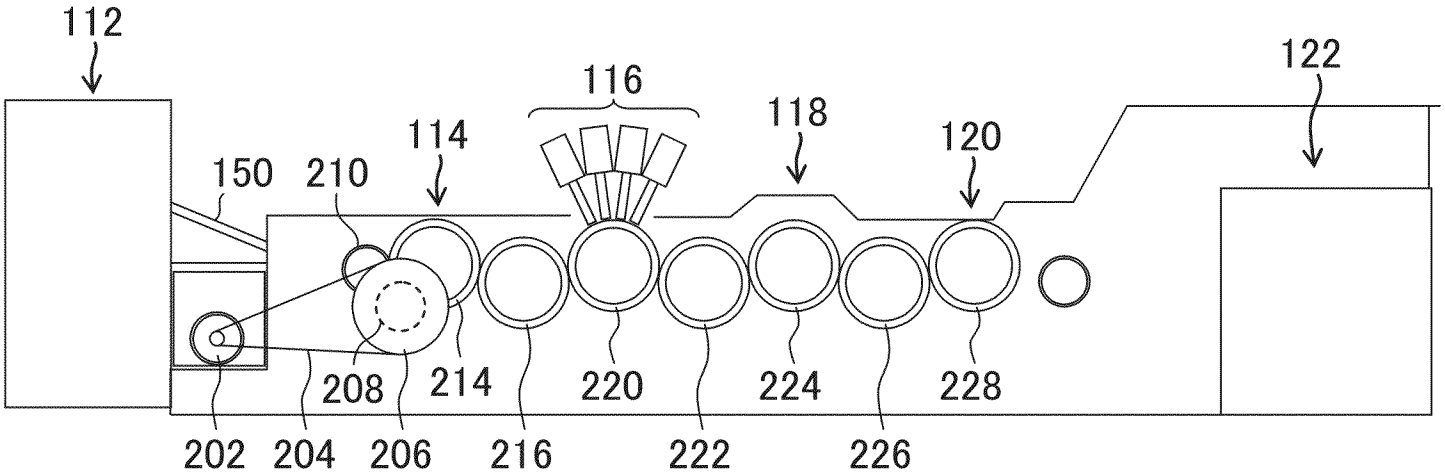
FIG. 10 is a schematic drawing of a drum rotation mechanism in the inkjet image forming apparatus shown in FIG. 9.

FIG. 9 is a general schematic drawing showing an example of the composition of an inkjet image forming apparatus relating to an embodiment of the present invention. FIG. 10 is a schematic drawing of a drum rotation drive mechanism which is provided on a side face on the opposite side to FIG. 9. As shown in these drawings, the inkjet image forming apparatus 100 according to the present embodiment principally includes a paper supply unit 112, a treatment liquid deposition unit (pre-coating unit) 114, an image formation unit 116, a drying unit 118, a fixing unit 120 and a paper output unit 122. The inkjet image forming apparatus 100 is an inkjet image forming apparatus using a single pass method which forms a desired color image by ejecting droplets of inks of a plurality of colors from long inkjet heads 172M, 172K, 172C and 172Y onto a recording medium 124 (also called "paper" below for the sake of convenience) held on a pressure drum (image formation drum 170) of the image formation unit 116. The inkjet recording apparatus 100 is an image forming apparatus of an on-demand type employing a two-liquid reaction (aggregation) method in which an image is formed on a recording medium 124 by depositing a treatment liquid (here, an aggregating treatment liquid) on the recording medium 124 before ejecting droplets of ink, and causing the treatment liquid and ink liquid to react together.

Paper Supply Unit

The paper supply unit 112 has a mechanism for supplying a recording medium 124 to the treatment liquid deposition unit 114, and recording media 124 (corresponding to "image formation receiving media"), which are cut sheet paper, are stacked in the paper supply unit 112. A paper supply tray 150 is provided in the paper supply unit 112, and the recording medium 124 is supplied one sheet at a time to the treatment liquid deposition unit 114 from the paper supply tray 150. It is possible to use recording media 124 of a plurality of types having different materials and dimensions (paper size) as the recording medium 124. It is also possible to use a mode in which a plurality of paper trays (not illustrated) for respectively and separately stacking recording media of different types are provided in the paper supply unit 112, and the paper supplied to the paper supply tray 150 among these plurality of paper trays is switched automatically, or a mode in which the operator selects the paper tray or replaces the paper tray according to requirements. In the present embodiment, cut sheet paper (cut paper) is used as the recording medium 124, but it is also possible to adopt a composition in which paper is supplied from a continuous roll (rolled paper) and is cut to the required size.

Treatment Liquid Deposition Unit

The treatment liquid deposition unit 114 is a mechanism which deposits treatment liquid onto a recording surface of the recording medium 124. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum 154 and a treatment liquid application apparatus 156. The treatment liquid drum 154 is a drum which holds the recording medium 124 and conveys the medium so as to rotate. The treatment liquid drum 154 includes a hook-shaped gripping device (gripper) 155 provided on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 tightly against the circumferential surface of the treatment liquid drum 154.

A treatment liquid application apparatus 156 is provided opposing the circumferential surface of the treatment liquid drum 154, to the outside of the drum. The treatment liquid application apparatus 156 includes a treatment liquid vessel in which treatment liquid is stored, an anilox roller which is partially immersed in the treatment liquid in the treatment liquid vessel, and a rubber roller which transfers a dosed amount of the treatment liquid to the recording medium 124, by being pressed against the anilox roller and the recording medium 124 on the treatment liquid drum 154. According to this treatment liquid application apparatus 156, it is possible to apply treatment liquid to the recording medium 124 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 124 onto which the treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 includes an image formation drum (also called an "imaging drum" or "jetting drum") 170, a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum. The recording medium 124 held on the image formation drum 170 is conveyed with the recording surface thereof facing to the outer side, and ink is deposited onto this recording surface from the inkjet heads 172M, 172K, 172C and 172Y.

The inkjet heads 172M, 172K, 172C and 172Y are each full-line type inkjet recording heads (inkjet heads) having a length corresponding to the maximum width of the image forming region on the recording medium 124, and a nozzle row (a two-dimensionally arranged nozzle row) of nozzles for ejecting ink arranged throughout the whole width of the image forming region is formed in the ink ejection surface of each head. The inkjet heads 172M, 172K, 172C and 172Y are disposed so as to each extend in a direction perpendicular to the conveyance direction of the recording medium 124 (the direction of rotation of the image formation drum 170).

When droplets of the corresponding colored inks are ejected from the inkjet heads 172M, 172K, 172C and 172Y toward the recording surface of the recording medium 124 which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

Although the configuration with the CMYK four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions on the sequence in which the heads of respective colors are arranged.

The recording medium 124 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which dries the water content contained in the solvent which has been separated by the action of aggregating the coloring material, and as shown in FIG. 9, includes a drying drum (also called a "drying cylinder") 176 and a solvent drying apparatus 178. Similarly to the treatment liquid drum 154, the drying drum 176 includes a hook-shaped holding device (gripper) 177 provided on the outer circumferential surface of the drum, in such a manner that the leading end of the recording medium 124 can be held by the holding device 177.

The solvent drying apparatus 178 is disposed in a position opposing the outer circumferential surface of the drying drum 176, and includes a plurality of halogen heaters 180 and hot air spraying nozzles 182 disposed respectively between the halogen heaters 180.

It is possible to achieve various drying conditions, by suitably adjusting the temperature and air flow volume of the hot air flow which is blown from the hot air flow spraying nozzles 182 toward the recording medium 124, and the temperatures of the respective halogen heaters 180.

Furthermore, the surface temperature of the drying drum 176 is set to not less than 50° C. By heating from the rear surface of the recording medium 124, drying is promoted and breaking of the image during fixing can be prevented. There are no particular restrictions on the upper limit of the surface temperature of the drying drum 176, but from the viewpoint of the safety (skin burn protection) of maintenance operations such as cleaning the ink adhering to the surface of the drying drum 176, desirably, the surface temperature of the drying drum 176 is not greater than 75° C. (and more desirably, not greater than 60° C.).

By holding the recording medium 124 on the outer circumferential surface of the drying drum 176 in such a manner that the recording surface the recording medium 124 is facing outwards (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

The recording medium 124 on which a drying process has been carried out in the drying unit 118 is transferred from the drying drum 176 to the fixing drum 184 of the fixing unit 120 via the intermediate conveyance unit 130.

Fixing Unit

The fixing unit 120 includes a fixing drum (or a fixing cylinder) 184, a halogen heater 186, a fixing roller 188 and an in-line sensor 190. Similarly to the treatment liquid drum 154, the fixing drum 184 includes a hook-shaped holding device (gripper) 185 provided on the outer circumferential surface of the drum, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The halogen heater 186 is controlled to a prescribed temperature (for example, 180° C.). By this means, preliminary heating of the recording medium 124 is carried out.

The fixing roller 188 is a roller member for melting self-dispersing polymer micro-particles contained in the ink and thereby causing the ink to form a film, by applying heat and pressure to the dried ink, and is composed so as to heat and pressurize the recording medium 124. More specifically, the fixing roller 188 is disposed so as to press against the fixing drum 184 in such a manner that a nip is created between the fixing roller and the fixing drum 184 (i.e. the fixing roller serves as a nip roller). By this means, the recording medium 124 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller formed by a pipe of metal having good thermal conductivity, such as aluminum, which internally incorporates a halogen lamp, and is controlled to a prescribed temperature (for example, 60° C. to 80° C.). By heating the recording medium 124 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 124, as well as leveling the undulations in the image surface and obtaining a glossy finish.

In the embodiment shown in FIG. 9, only one fixing roller 188 is provided, but it is also possible to provide fixing rollers in a plurality of stages, in accordance with the thickness of the image layer and the Tg characteristics of the latex particles.

On the other hand, the in-line sensor 190 is a measurement device for measuring an ejection defect checking pattern, the image density, image defects, or the like (including a test pattern, and the like) with respect to an image which has been recorded on the recording medium 124; a CCD line sensor, or the like, is employed for the in-line sensor 190.

According to the fixing unit 120 having the composition described above, the latex particles in the thin image layer formed by the drying unit 118 are heated, pressurized and melted by the fixing roller 188, and hence the image layer can be fixed to the recording medium 124. Furthermore, the surface temperature of the fixing drum 184 is set to not less than 50° C. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 includes a UV exposure unit for exposing the ink on the recording medium 124 to UV light, instead of the heat and pressure fixing unit (fixing roller 188) based on a heat roller. In this way, if using an ink containing an active light-curable resin, such as an ultraviolet-curable resin, a device which irradiates the active light, such as a UV lamp or an ultraviolet LD (laser diode) array, is provided instead of the fixing roller 188 for heat fixing.

Paper Output Unit

As shown in FIG. 9, a paper output unit 122 is provided subsequently to the fixing unit 120. The paper output unit 122 includes an output tray 192, and a transfer drum 194, a conveyance belt 196 and a tensioning roller 198 are provided between the output tray 192 and the fixing drum 184 of the fixing unit 120 so as to oppose same. The recording medium 124 is sent to the conveyance belt 196 by the transfer drum 194 and output to the output tray 192. The details of the paper conveyance mechanism created by the conveyance belt 196 are not shown, but the leading end portion of a recording medium 124 after printing is held by a gripper on a bar (not illustrated) spanned across the endless conveyance belt 196, and the recording medium is conveyed above the output tray 192 due to the rotation of the conveyance belts 196.

Furthermore, although not shown in FIG. 9, the inkjet image forming apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, temperature sensors which determine the temperature of the respective units of the apparatus, and the like.

Rotation Drive Mechanism of Drum (Cylinder)

As shown in FIG. 10, the inkjet image forming apparatus 100 includes a motor (corresponding to a "drive force generating device", called a "drum rotation motor" below) 202, as a source of drive force. The drive force of the drum rotation motor 202 is transmitted to a pulley 206 via a timing belt (an endless toothed belt) 204. A gear wheel 208 is coupled coaxially in an integrated fashion to the pulley 206, and the gear wheel 208 is rotated together with the pulley 206. A gear wheel 210 which meshes with this gear wheel 208 is provided on the upper left-hand side of the gear wheel 208 in FIG. 10, and the gear wheel 210 meshes (engages) with a gear wheel 214 which is coupled directly to the end portion of a treatment liquid drum 154 in the pre-coating unit (treatment liquid deposition unit 114). The gear wheel 214 of the treatment liquid drum 154 meshes with a gear wheel 216 which is provided on an end portion of a transfer drum which constitutes the intermediate conveyance unit 126, and this gear wheel 216 meshes with a gear wheel 220 which is provided on an end portion of the image formation drum 170 in the image formation unit 116. Therefore, the gear wheel 220 meshes with a gear wheel 222 of the transfer drum which constitutes the intermediate conveyance unit 128, and also a gear wheel 224 of the drying drum 176, a gear wheel 226 of a transfer drum of the intermediate conveyance unit 130, and a gear wheel 228 of the fixing drum 184 meshes successively with each other.

The respective gear wheels 214 to 228 are drum rotating gears, and form a mutually coupled structure. The drive force of the drum rotation motor 202 is transmitted to the gear wheels 214 to 228 via the timing belt 204, the pulley 206, and the gear wheels 208 and 210, and all of the drums (154, 170, 176 and 184) and the transfer drums of the intermediate conveyance units (126, 128, 130) are caused to rotate by the coupled action of these gear wheels 214 to 228. In the case of the present embodiment, the diameters of the drums (154, 170, 176, 184) and the transfer drums, and the diameters of the gear wheels 214 to 228 (diameter of pitch circle) are matching, and when the treatment liquid drum 154 performs one revolution, the image formation drum 170, the drying drum 176 and the fixing drum 184 also perform one revolution.

Figure 11:
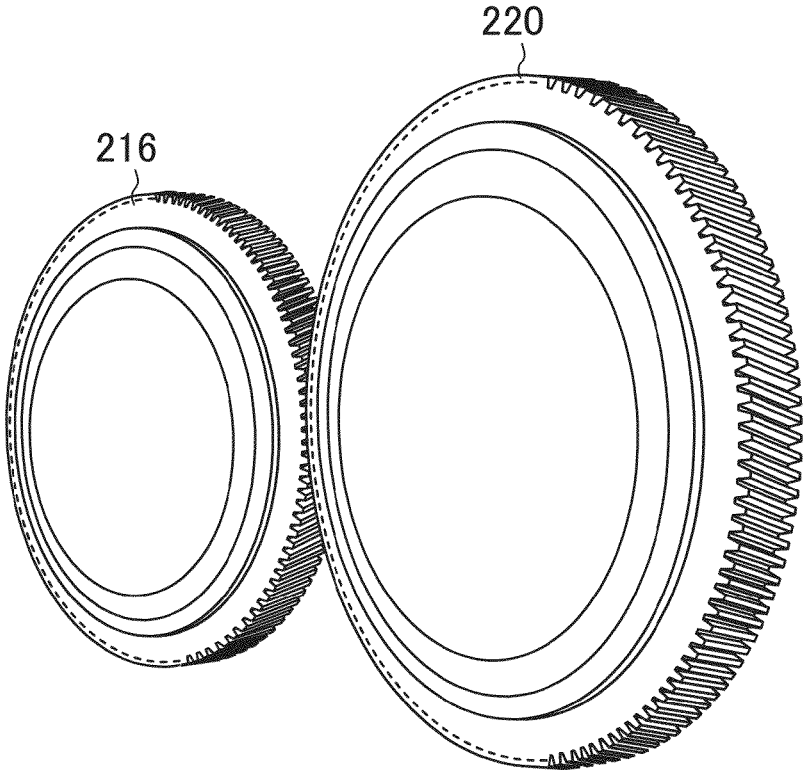
FIG. 11 is an enlarged perspective diagram of a drum rotation gear portion employed in an inkjet image forming apparatus according to an embodiment of the invention.

FIG. 11 is an enlarged diagram of a drum rotation gear section which causes the image formation drum 170 to rotate. As shown in FIG. 10, helical gears are used for the gear wheels of the drive transmission member. It is possible to use spur gears for the gear wheels, but in order to achieve a smooth transmission of the drive force, it is desirable to use helical gears (see FIG. 10), or double helical gears (herring-bone gear, not illustrated). A helical gear wheel has obliquely formed teeth and is able to achieve smooth transmission of drive force. A double helical gear wheel has a benefit in that the force in the thrust direction can be reduced in comparison with a helical gear, but costs more than a helical gear. Consequently, in the present embodiment, a helical gear is used from the viewpoint of achieving both low costs and smooth transmission of drive force. A helical gear may be more liable to produce vibration in the x direction compared to a spur gear, and the present invention can be effectively applied as a technology for suppressing vibration non-uniformity caused by relative vibration in the x direction.

A composition is adopted whereby the relationship between the drum rotation motor 202 and the drive force transmission mechanism shown in FIG. 9 to FIG. 11 and the nozzle arrangement of the inkjet heads 172M, 172K, 172C, 172Y satisfies Relationship 1, 2 or 3.

Speed Reduction Ratio R Between Motor and Drum and Vibration Period Pv on Paper

The gear reduction ratio R from the drum rotation motor 202 to the drums (154, 170, 176, 184) in the inkjet image forming apparatus 100 is calculated as shown below.

Figure 12:
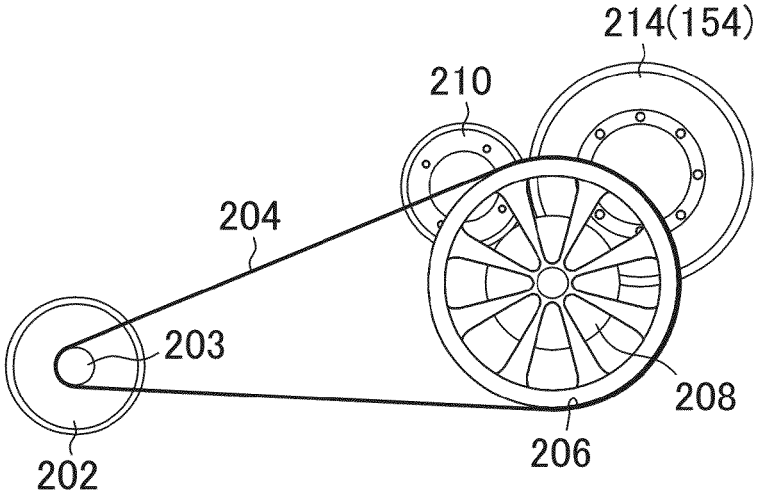
FIG. 12 is a schematic drawing showing an enlarged view of a portion of the reducing gear system in the drum rotation mechanism shown in FIG. 10.

As shown in FIG. 12, when the diameter of a pulley 203 fixed to the end of the shaft of the drum rotation motor 202 is represented by Dm, when the diameter of the pulley 206 driven by the timing belt 204 is represented by Dp, when the diameter of a gear wheel 208 which rotates coaxially with and in unison with the pulley 206 is represented by Dg1, when the diameter of a gear wheel 210 which meshes with the gear wheel 208 is equal to the diameter (Dg1) of the gear wheel 208, when the diameter of a gear wheel 214 directly coupled to the drum 154 is represented by Dg2, and when the diameter of the drum 154 is represented by Ddr, then the gear reduction ratio R is expressed by the following equation (Formula 6).

$$R=(Dm/Dp)\cdot(Dg1/Dg2) \qquad \text{Formula 6}$$

The vibration period Pv on the paper as determined from Formula 6 and Formula 1 is as indicated below.

$$Pv=\pi\cdot Ddr\cdot(Dm/Dp)\cdot(Dg1/Dg2)/Nm \qquad \text{Formula 7}$$

The gear reduction ratio R and the nozzle layout are set in such a manner that the vibration period Pv expressed by Formula 7 satisfies the Relationship 1: OSy≈k·Pv (where k is a natural number). More specifically, the relationship between the number of revolutions of the motor including the gear reduction ratio and the offset amount of the y-offset adjacent nozzle pair is set in accordance with Relationship 1, 2 or 3.

Order Nm of Rotational Non-Uniformity of Motor

Figure 13:
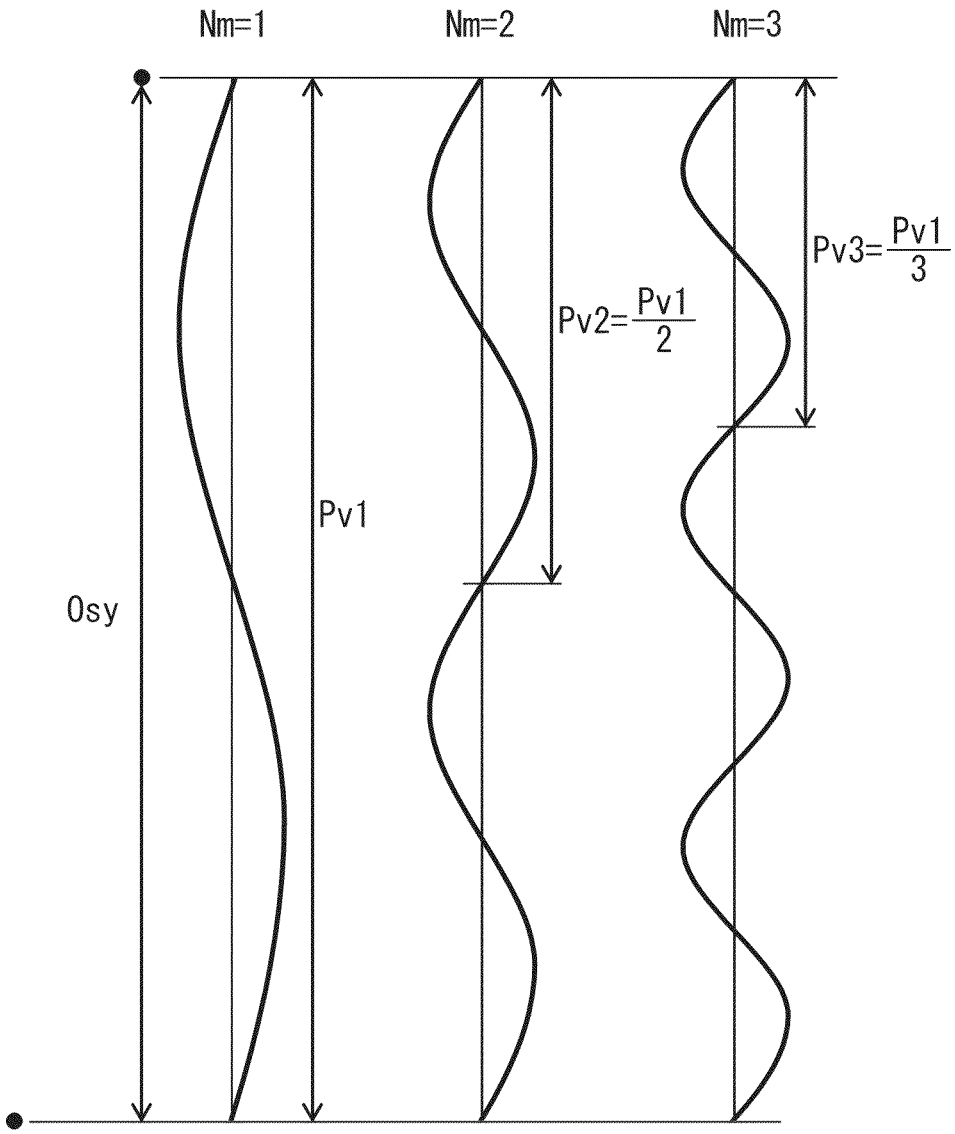
FIG. 13 is an illustrative diagram showing a schematic diagram of the relationship between the order Nm of rotational non-uniformity of a motor and a vibration period Pv.

FIG. 13 is an illustrative diagram showing a schematic view of the relationship between the order Nm of the rotational non-uniformity of the motor and the vibration period Pv. When the period on the paper corresponding to a rotational non-uniformity having a basic period which occurs once with each revolution of the motor (order Nm=1) is represented by Pv1, then the period Pv2 on the paper which corresponds to rotational non-uniformity of the order Nm=2 is ½ of Pv1 (Pv2=Pv1/2) and the period Pv3 on the paper which corresponds to a rotational non-uniformity of the order Nm=3 is ⅓ of Pv (Pv3=Pv1/3).

According to Relationship 1 stated above, if the period Pv1 on the paper of the rotational non-uniformity having the basic period (order Nm=1) which occurs once with each revolution of the motor is set so as to be a natural number k multiple of the offset amount OSy between the y-offset adjacent nozzle pairs (FIG. 13 shows an example where k=1), then it is possible to suppress variation in the pitch between the rasters of the y-offset adjacent nozzle pairs and vibration non-uniformity can be reduced.

In this case, with the higher-order rotational non-uniformities where the order Nm=2 and the order Nm=3, as shown in FIG. 13, the value of OSy is a natural number multiple of the vibration period Pv2=(Pv1)/2 and Pv3=(Pv1)/3 respectively. For this reason, the vibration non-uniformity is also reduced in respect of high-frequency rotational non-uniformity.

More specifically, in respect of the order of higher harmonics of rotational non-uniformity produced by the motor, provided that Relationship 1 is satisfied for Nm=1, then this relationship is also satisfied for Nm=2, 3, and so on, which is desirable. However, in a case where the rotational non-uniformity at Nm=1 is so small as to be negligible and the rotational non-uniform at Nm=2 is relatively large and presents a problem in terms of image quality, then it is sufficient if Relationship 1 is satisfied at Nm=2.

Modification Example of Meshing Transmission Mechanism

Figure 14:
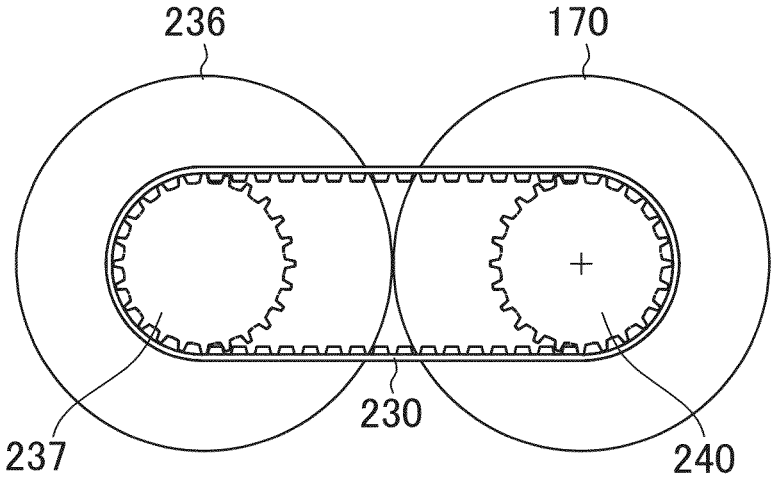
FIG. 14 is a diagram showing a mode where a toothed belt (timing belt) is used as a further example of a meshing transmission mechanism.

Instead of the gear transmission mechanism described in FIG. 9 to FIG. 10, it is also possible to adopt a composition which rotates a drum by using a toothed belt (timing belt) 230 as shown in FIG. 14. FIG. 14 shows an example of the transfer drum 236 of the intermediate conveyance unit 126 and the image formation drum 170, but the present invention can also be applied similarly to other drums. As shown in FIG. 14, it is also possible to transmit drive force by means of a mechanism in which an endless toothed belt 230 is wrapped between a gear (pulley) 237 which is directly connected to the shaft of the transfer drum 236, and a gear (pulley) 240 which is directly connected to the shaft of the image formation drum 170.

Inkjet Head Structural Examples

Next, the structure of an inkjet head will be described. The heads 172M, 172K, 172C and 172Y corresponding to respective colors have the same structure, and a reference numeral 250 is hereinafter designated to any of the heads.

Figure 15A:
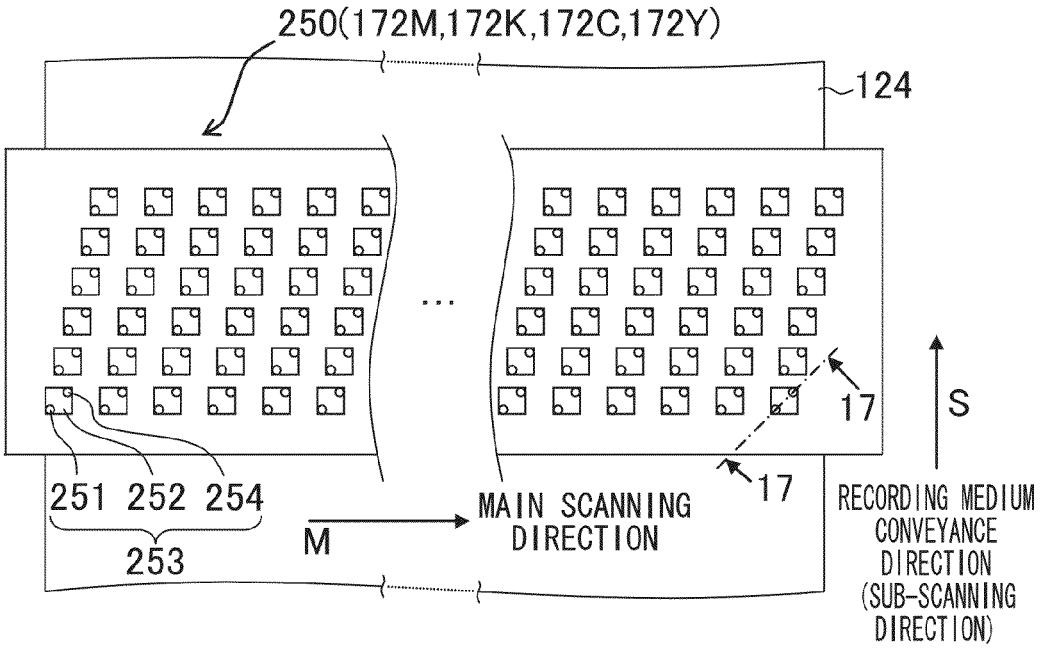
FIGS. 15A and 15B are plan view perspective diagrams showing an example of the composition of an inkjet head.
Figure 15B:
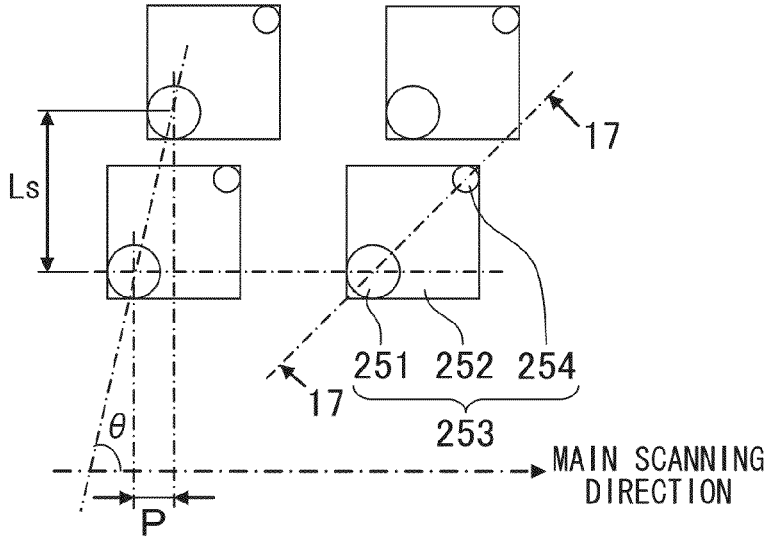
Figure 16A:
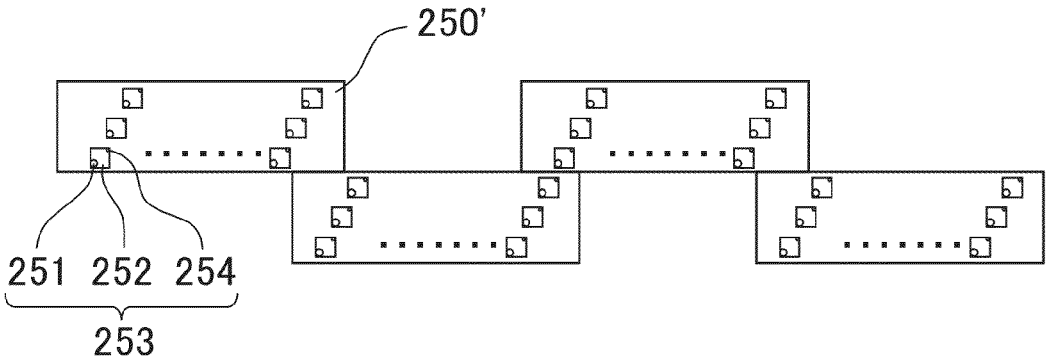
FIGS. 16A and 16B are diagrams showing examples of a head bar composed by joining together a plurality of head modules.
Figure 16B:
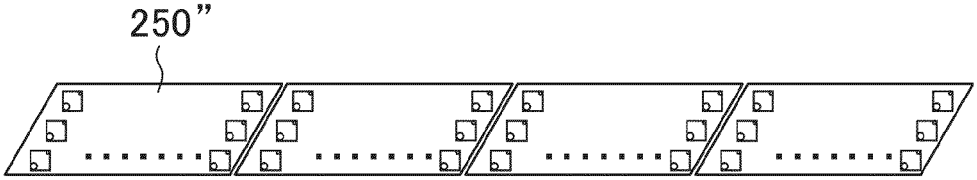
Figure 17:
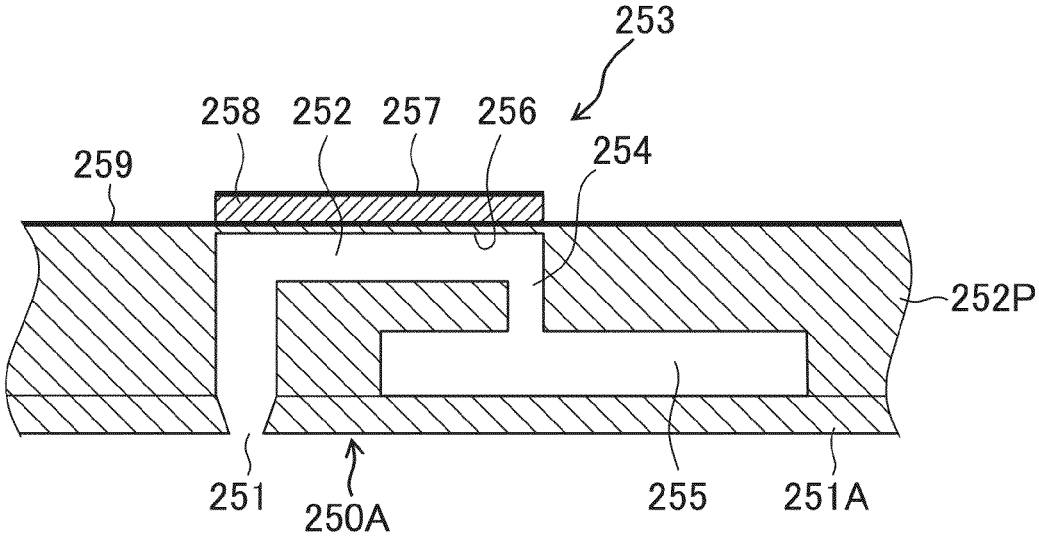
FIG. 17 is a cross-sectional diagram along line 17-17 in FIGS. 15A and 15B.

FIG. 15A is a perspective plan view showing an example of the configuration of the head 250, FIG. 15B is an enlarged view of a portion thereof, FIGS. 16A and 16B are perspective plan views showing other examples of the configuration of the head 250, and FIG. 17 is a cross-sectional view (a cross-sectional view taken along the line 17-17 in FIGS. 15A and 15B) showing the structure of a droplet ejection element (an ink chamber unit for one nozzle 251) corresponding to one channel serving as a recording element unit.

As shown in FIGS. 15A and 15B, the head 250 according to the present embodiment has a structure in which a plurality of ink chamber units (droplet ejection elements) 253 each comprising a nozzle 251 forming an ink ejection port, a pressure chamber 252 corresponding to the nozzle 251, and the like, are disposed two-dimensionally in the form of a matrix, and hence the effective nozzle interval (the projected nozzle pitch) as projected (orthographically-projected) so as to be aligned in the lengthwise direction of the head (the direction perpendicular to the paper conveyance direction) is reduced and high nozzle density is achieved.

The mode of composing a nozzle row having a length equal to or greater than the full width Wm of the image formation region of the recording medium 124 in a direction (the direction indicated by arrow M, corresponding to the second direction) which is substantially perpendicular to the feed direction of the recording medium 124 (the direction indicated by arrow S, corresponding to the first direction) is not limited to the present example. For example, instead of the composition in FIG. 15A, it is possible to adopt a mode in which a line head having a nozzle row of a length corresponding to the full width of the recording medium 124 is composed by joining together short head modules 250' in which a plurality of nozzles 251 are arranged in a two-dimensional arrangement, in a staggered configuration as shown in FIG. 16A, or a mode in which head modules 250" are joined together in an alignment in one row as shown in FIG. 16B.

It is not limited to a case where the full surface of the recording medium 124 is taken as the image formation range, and in cases where a portion of the surface of the recording medium 124 is taken as the image formation region (for example, if a non-image formation region (blank margin portion) is provided at the periphery of the paper, or the like), it is enough to form nozzle rows required for image formation in the prescribed image formation range.

The pressure chambers 252 provided to correspond to the respective nozzles 251 have a substantially square planar shape (see FIGS. 15A and 15B), an outlet port to the nozzle 251 being provided in one corner of a diagonal of each pressure chamber, and an ink inlet port (supply port) 254 being provided in the other corner thereof. The shape of the pressure chambers 252 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 17, a head 250 has a structure in which a nozzle plate 251A in which nozzles 251 are formed, a flow channel plate 252P in which flow channels such as pressure chambers 252 and a common flow channel 255, and the like, are formed, and so on, are layered and bonded together. The nozzle plate 251A constitutes the nozzle surface (ink ejection surface) 250A of the head 250 and a plurality of nozzles 251 which are connected respectively to the pressure chambers 252 are formed in a two-dimensional configuration therein.

The flow channel plate 252P is a flow channel forming member which constitutes side wall portions of the pressure chambers 252 and in which a supply port 254 is formed to serve as a restricting section (most constricted portion) of an individual supply channel for guiding ink to each pressure chamber 252 from the common flow channel 255. For the sake of the description, a simplified view is given in FIG. 17, but the flow channel plate 252P has a structure formed by layering together one or a plurality of substrates.

The nozzle plate 251A and the flow channel plate 252P can be processed into a required shape by a semiconductor manufacturing process using silicon as a material.

The common flow channel 255 is connected to an ink tank (not shown) which is a base tank that supplies ink, and the ink supplied from the ink tank is supplied through the common flow channel 255 to the pressure chambers 252.

Piezoelectric actuators 258 each provided with an individual electrode 257 are bonded to a diaphragm 256 which constitutes a portion of the surfaces of the pressure chambers 252 (the ceiling surface in FIG. 17). The diaphragm 256 according to the present embodiment is made of silicon (Si) having a nickel (Ni) conducting layer which functions as a common electrode 259 corresponding to the lower electrodes of the piezoelectric actuators 258, and serves as a common electrode for the piezoelectric actuators 258 which are arranged so as to correspond to the respective pressure chambers 252. A mode is also possible in which a diaphragm is made from a non-conductive material, such as resin, and in such a mode, a common electrode layer made of a conductive material, such as metal, is formed on the surface of the diaphragm member. Furthermore, the diaphragm which also serves as a common electrode may be made of a metal (conductive material), such as stainless steel (SUS), or the like.

When a drive voltage is applied to an individual electrode 257, the corresponding piezoelectric actuator 258 deforms, thereby changing the volume of the corresponding pressure chamber 252. This causes a pressure change which results in ink being ejected from the corresponding nozzle 251. When the piezoelectric actuator 258 returns to its original position after ejecting ink, the pressure chamber 252 is replenished with new ink from the common flow channel 255 via the supply port 254.

As shown in FIG. 15B, the high-density nozzle head according to the present embodiment is achieved by arranging a plurality of ink chamber units 253 having the above-described structure in a lattice fashion based on a uniform arrangement pattern, in a row direction which coincides with the main scanning direction, and a column direction which is inclined at a fixed angle of θ with respect to the main scanning direction, rather than being perpendicular to the main scanning direction. In the arrangement of such a matrix, when a pitch between adjacent nozzles in the sub-scanning direction is represented by $L_S$, it can be assumed equivalently that the nozzles 251 are substantially arranged linearly at a predetermined pitch of $P=L_S/\tan\theta$.

Furthermore, in implementing the present invention, the mode of arrangement of the nozzles 251 in the head 250 is not limited to the examples shown in the drawings, and it is possible to adopt various nozzle arrangements. For example, instead of the matrix arrangement shown in FIGS. 15A and 15B, it is possible to use a bent line-shaped nozzle arrangement, such as a V-shaped nozzle arrangement, or a zigzag shape (W shape, or the like) in which a V-shaped nozzle arrangement is repeated (i.e. a V-shaped nozzle arrangement is used as a unit).

The device for generating ejection pressure (ejection energy) for ejecting droplets from the nozzles in the inkjet head is not limited to a piezoelectric actuator (piezoelectric element), and it is also possible to employ pressure generating elements (energy generating elements) of various types, such as a heater (heating element) in a thermal method (a method which ejects ink by using the pressure created by film boiling upon heating by a heater) or actuators of various kinds based on other methods. A corresponding energy generating element is provided in the flow channel structure in accordance with the ejection method of the head.

Description of Control System

Figure 18:
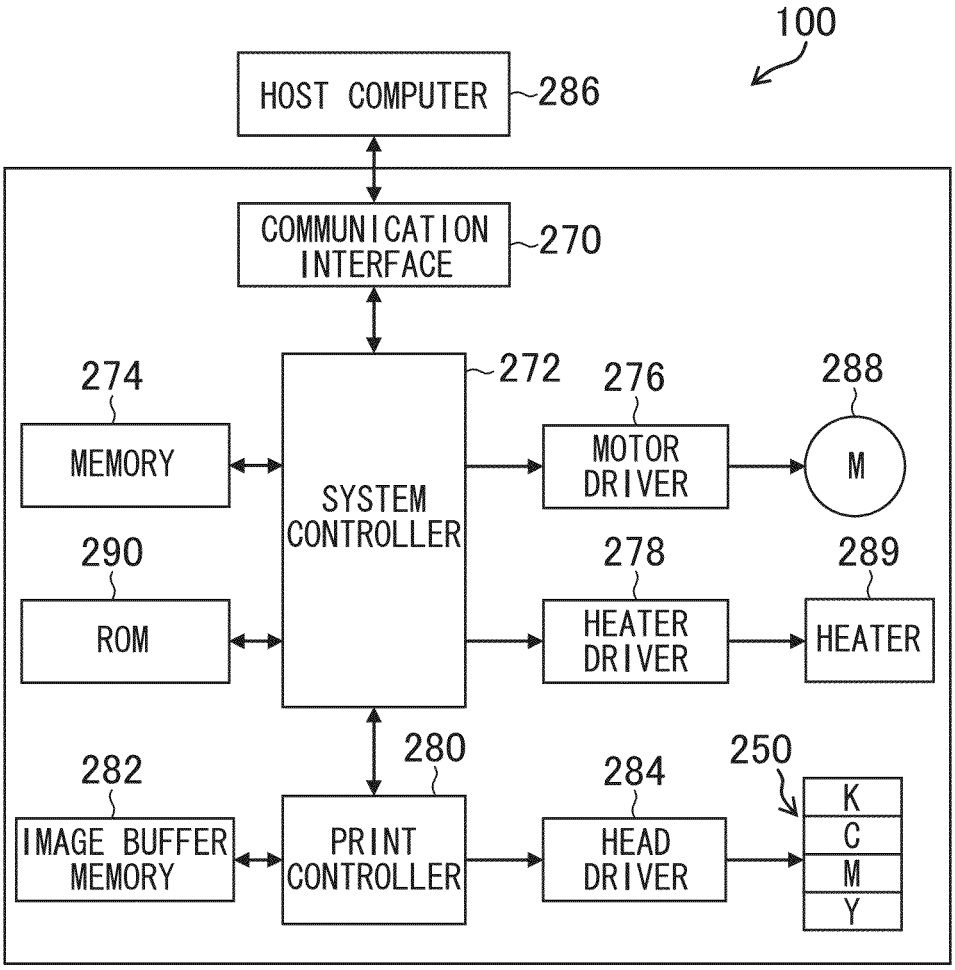
FIG. 18 is a block diagram showing the composition of a control system of an inkjet image forming apparatus.

FIG. 18 is a main part block diagram showing the system configuration of the inkjet image forming apparatus 100. The inkjet image forming apparatus 100 comprises a communication interface 270, a system controller 272, a memory 274, a motor driver 276, a heater driver 278, a print controller 280, an image buffer memory 282, a head driver 284, and the like.

The communication interface 270 is an interface unit for receiving image data sent from a host computer 286. A serial interface such as USB (Universal Serial Bus), IEEE1394, Ethernet (registered trademark), or wireless network, or a parallel interface such as a Centronics interface may be used as the communication interface 270. A buffer memory (not shown) may be mounted in this portion in order to increase the communication speed. The image data sent from the host computer 286 is received by the inkjet image forming apparatus 100 through the communication interface 270, and is temporarily stored in the memory 274.

The memory 274 is a storage device for temporarily storing images inputted through the communication interface 270, and data is written and read to and from the memory 274 through the system controller 272. The memory 274 is not limited to a memory composed of semiconductor elements, and a hard disk drive or another magnetic medium may be used.

The system controller 272 is constituted by a central processing unit (CPU) and peripheral circuits thereof, and the like, and it functions as a control device for controlling the whole of the inkjet image forming apparatus 100 in accordance with a prescribed program, as well as a calculation device for performing various calculations. More specifically, the system controller 272 controls the various sections, such as the communication interface 270, memory 274, motor driver 276, heater driver 278, and the like, as well as controlling communications with the host computer 286 and writing and reading to and from the memory 274, and it also generates control signals for controlling the motor 288 (including the drum rotation motor 202 explained in FIG. 10) of the conveyance system and a heater 289.

Control programs of various types and parameters of various types, and the like, are stored in the ROM 290, and the control programs are read out and executed in accordance with instructions from the system controller 272.

The image memory 274 is used as a temporary storage region for the image data, and it is also used as a program development region and a calculation work region for the CPU.

The motor driver 276 is a driver which drives the motor 288 in accordance with instructions from the system controller 272. In FIG. 18, various motors arranged in the respective units of the apparatus are represented by the reference numeral 288.

The heater driver 278 is a driver which drives the heater 289 in accordance with instructions from the system controller 272. In FIG. 18, various heaters arranged in the respective units of the apparatus are represented by the reference numeral 289.

The print controller 280 has a signal processing function for performing various tasks, compensations, and other types of processing for generating print control signals from the image data stored in the memory 274 in accordance with commands from the system controller 272 so as to supply the generated print data (dot image data) to the head driver 284.

In general, the dot image data is generated by subjecting the multiple-tone image data to color conversion processing and halftone processing. The color conversion processing is processing for converting image data represented by a sRGB system, for instance (for example, 8-bit image data for each RGB color) into color data of the respective colors of ink used by the inkjet image forming apparatus 100 (KCMY color data, in the present embodiment).

Half-tone processing is processing for converting the color data of the respective colors generated by the color conversion processing into dot data of respective colors (in the present embodiment, KCMY dot data) by error diffusion or a threshold matrix method, or the like.

Required signal processing is carried out in the print controller 280, and the ejection amount and the ejection timing of the ink droplets from the respective print heads 250 are controlled via the head driver 284, on the basis of the dot data obtained. By this means, desired dot size and dot positions can be achieved.

An image buffer memory 282 is provided in the print controller 280, and data such as image data and parameters, is stored temporarily in the image buffer memory 282 during processing of the image data in the print controller 280. Furthermore, also possible is a mode in which the print controller 280 and the system controller 272 are integrated to form a single processor.

The head driver 284 can be provided with a feedback control system for maintaining constant drive conditions for the head 250.

The inkjet image forming apparatus 100 shown in the present embodiment employs a drive method in which a common drive power waveform signal is applied to the piezo actuators 258 of the head 250, and ink is ejected from the nozzles 251 corresponding to the respective piezo actuators 258 by turning switching elements (not illustrated) connected to the individual electrodes for the piezo actuators 258 on and off, in accordance with the ejection timing of the respective piezo actuators 258.

Mode of Head Bar in which a Plurality of Head Modules are Joined Together

As shown in the example in FIG. 16A, if one long head is composed by aligning a plurality of head modules each having a two-dimensional nozzle arrangement in a staggered configuration, then there are similar problems of vibration non-uniformity in the y-offset adjacent nozzle pairs which span between different head modules, as well as the y-offset adjacent nozzle pairs in the same head module, and these problems can be resolved by similar means.

Figure 19:
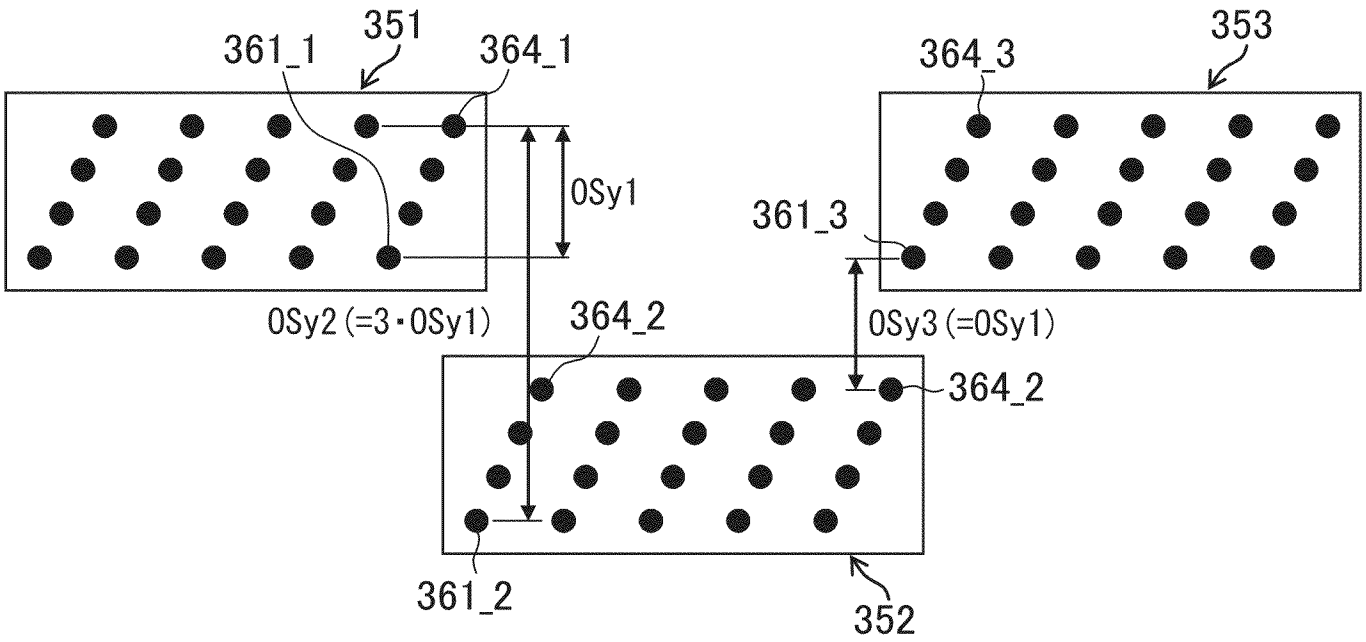
FIG. 19 is an illustrative diagram of the amount of offset of a y-offset adjacent nozzle pair which spans different head modules.

FIG. 19 shows a schematic drawing of a staggered matrix head. FIG. 19 shows an example where three head modules 351, 352, 353 are arranged in a staggered configuration.

The maximum value of the offset amount of the y-offset adjacent nozzle pairs in the respective head modules 351, 352, 353 is taken as OSy1. In the example illustrated in FIG. 19, the offset amount of the y-offset adjacent nozzle pair comprising a nozzle 361_*i* of the first row (bottommost row) in the module (where i=1, 2, 3) and a nozzle 364_*i* of the fourth row (uppermost row) is OSy1.

Furthermore, the offset amount of a y-offset adjacent nozzle pair which spans between different head modules 351 and 352 located in a separated fashion in the y direction (nozzle 364_1 and nozzle 361_2) is OSy2, and the offset amount of a y-offset adjacent nozzle pair (nozzle 364_2 and nozzle 361_3) which spans between the head modules 352 and 353 is OSy3.

OSy1 is designed so as to satisfy Relationship 1, Relationship 2 or Relationship 3, and OSy2 and OSy3 are designed respectively to be an integral multiple of OSy1. By means of a composition of this kind, each of OSy1, OSy2 and OSy3 satisfies Relationship 1, Relationship 2 or Relationship 3. FIG. 19 shows an example where OSy2=3×OSy1 and OSy3=OSy1, but in implementing the present invention, the value of the multiple is not limited in particular. OSy2 and OSy3 correspond to "OSy_B".

By means of a composition of this kind, it is possible also to suppress vibration non-uniformity in a y-offset adjacent nozzle pair which spans between head modules. The mode of arrangement of the head modules is not limited to a staggered arrangement, and it is also possible to employ a similar device to that described above in a mode where modules are situated at different positions in the y direction.

The example shown in FIG. 19 is a case where each of OSy1, OSy2 and OSy3 satisfy Relationship 1, Relationship 2 or Relationship 3, but if the offset amount (OSy1) of the y-offset adjacent nozzle pairs within a head module is small, then it is possible to satisfy Relationship 1, Relationship 2 or Relationship 3 only in respect of the offset amount between head modules (OSy2, OSy3).

Mode of Invention as Design Method

From the findings described above, in manufacturing an inkjet image forming apparatus, it is beneficial that the nozzle arrangement and the meshing transmission mechanism are designed so as to satisfy Relationship 1, Relationship 2 or Relationship 3. For example, in designing the dimensions of the offset amount of the y-offset adjacent nozzle pairs in the nozzle arrangement, a suitable offset amount is specified on the basis of the rotational non-uniformity characteristics of the motor (order: Nm) and the gear reduction ratio of the drive force transmission mechanism. Alternatively, if the nozzle arrangement has already been designed, then a suitable combination of a motor and a drive force transmission mechanism is specified in relation to this nozzle arrangement. In this way, by adopting a design which takes account of the relationship between the nozzle arrangement and the motor drive force transmission system, it is possible to manufacture an inkjet image forming apparatus having reduced vibration non-uniformity.

Mode of Invention as Method of Improving Image Formation Quality of Inkjet Image Forming Apparatus Furthermore, by adopting technology for suppressing vibration non-uniformity by satisfying Relationship 1, Relationship 2 or Relationship 3 stated above, it is possible to improve image formation quality by modifying the design or the components of the drive force transmission system, without modifying the design of the already designed inkjet head or the manufactured inkjet head.

This can be utilized as repair/improvement technology which is capable of dramatically improving image formation performance by modifying an inkjet image forming apparatus which has been manufactured without regard to Relationship 1, Relationship 2 or Relationship 3, so that the drive force transmission mechanism (including the speed reduction system) takes account of these relationships.

More specifically, the number of revolutions of the motor including the gear reduction ratio is optimized and the image formation quality is improved, by means of a first step of acquiring information about the vibration period Pv on the paper corresponding to the rotational non-uniformity of the motor, a second step of acquiring information about the offset amount OSy of the y-offset adjacent nozzle pairs in the two-dimensional nozzle arrangement, and a third step of changing the gear reduction ratio of the drive force transmission mechanism on the basis of the information about Pv and OSy obtained in the first and second steps, so as to satisfy the relationship $OSy \approx k \times Pv$ (where k is a natural number).

MODIFICATION EXAMPLE 1

In implementing the present invention, the mechanism for transmitting drive force from the motor is not limited to the composition of components described in relation to FIG. 10 to FIG. 12 (a timing belt 204, pulleys 203, 206, gear wheels 208, 210, 214, etc.), and this mechanism may adopt various modes.

MODIFICATION EXAMPLE 2

In the embodiment described above, a drum rotation method is used, but the composition for performing relative scanning of the paper and head is not limited to this. For example, it is also possible to adopt a mode in which the paper is fixed to a flat plate-shaped stage and the stage is conveyed in the y direction. In this case, it is possible to employ a mode for driving the stage by providing a linear gear (rack) on the stage, for example, as a device for moving the stage, and rotating a gear wheel (pinion) which meshes with the rack. Furthermore, instead of a rack and pinion system of this kind, it is also possible to employ a composition which uses a ball screw and moves a stage in the axial direction of the ball screw by turning the ball screw. Even in a conveyance method of this kind, similar problems arise and can be solved by a similar device.

MODIFICATION EXAMPLE 3

In the embodiment described above, an example is given in which a recording medium is conveyed with respect to a stationary head, but in implementing the present invention, it is also possible to move a head with respect to a stationary recording medium (image formation receiving medium). Furthermore, it is possible to employ a method which performs image formation by moving both the head and the recording medium (image formation receiving medium). With any of these compositions also, similar problems arise and can be solved by a similar device.

Recording Medium

In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, a printed substrate on which a wiring pattern, or the like, is formed, or a rubber sheet.

Application Examples of the Present Invention

In the embodiment described above, application to an inkjet recording apparatus for graphic printing is described by way of example, but the scope of application of the present invention is not limited to this example. For example, the present invention can also be applied widely to inkjet systems which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet image forming apparatus comprising:

a liquid ejection head having an ejection surface in which a plurality of nozzles are arranged two-dimensionally;

a scanning device which conveys at least one of the liquid ejection head and an image formation receiving medium on which liquid ejected from the plurality of nozzles is deposited, to cause relative movement between the image formation receiving medium and the liquid ejection head in a first direction;

a motor which is a driving source for driving the scanning device; and a drive force transmission mechanism which transmits drive force generated by the motor to the scanning device, wherein:

in a case where rotational non-uniformity can occur Nm times for each revolution of the motor, where Nm is a natural number, and when Pv represents a spatial period representing an amount of the relative movement in the first direction on the image formation receiving medium corresponding to 1/Nm revolution of the motor, and when OSy represents an offset distance in the first direction of a pair of nozzles which form dots that are mutually adjacent in a second direction perpendicular to the first direction on the image formation receiving medium, of the plurality of nozzles arranged two-dimensionally, then relationship of OSy≈k×Pv, where k is a natural number, is satisfied.

2. The inkjet image forming apparatus as defined in claim 1, wherein the relationship of $$|\sin\{\pi \cdot OSy/Pv\}| \leq 1/4$$

is satisfied.

3. The inkjet image forming apparatus as defined in claim 1, wherein a group of the plurality of nozzles arranged two-dimensionally includes the pairs of nozzles, as defined in claim 1, at least two of the pairs within the group having mutually different offset distances, and the relationship is satisfied, with a maximum value of the different offset distances being taken as OSy.

4. The inkjet image forming apparatus as defined in claim 1, wherein:

the liquid ejection head is formed by joining together a plurality of head modules each of which has an ejection surface in which a plurality of nozzles are arranged two-dimensionally; and when the offset distance of the pair of nozzles which spans different head modules of the plurality of head modules is represented by OSy_B, the relationship is satisfied by taking OSy_B as OSy.

5. The inkjet image forming apparatus as defined in claim 4, wherein the plurality of head modules are disposed in a staggered arrangement.

6. The inkjet image formation apparatus as defined in claim 1, wherein:

the scanning device includes a medium conveyance device which conveys the image formation receiving medium, and the medium conveyance device employs a drum rotation system which holds the image formation receiving medium on a cylindrical surface of a drum and rotates the drum.

7. The inkjet image forming apparatus as defined in claim 6, wherein, when a diameter of the drum is represented by Ddr and a speed reduction ratio of the drive force transmission mechanism is represented by R, then Pv which indicates a period of vibration appearing on the image formation receiving medium as a result of rotation of the motor is expressed by $$Pv = \pi \cdot Ddr \cdot R/Nm.$$

8. The inkjet image forming apparatus as defined in claim 1, carrying out image formation based on a single pass method such that the relative movement between the image formation receiving medium and the liquid ejection head is caused just once in the first direction by the scanning device to form an image on the image formation receiving medium.

9. A method of designing an inkjet image forming apparatus including: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, wherein:

in a case where rotational non-uniformity can occur Nm times for each revolution of the motor, where Nm is a natural number, and when Pv represents a spatial period representing an amount of the relative movement in the first direction on the image formation receiving medium corresponding to 1/Nm revolution of the motor, and when OSy represents an offset distance in the first direction of a pair of nozzles which form dots that are mutually adjacent in a second direction perpendicular to the first direction on the image formation receiving medium, of the plurality of nozzles arranged two-dimensionally, then arrangement of the plurality of nozzles in the liquid ejection head and a speed reduction ratio of the drive force transmission mechanism are specified in such a manner that relationship of OSy≈k×Pv, where k is a natural number, is satisfied.

10. A method of improving image formation quality of an inkjet image forming apparatus including: a liquid ejection head having an ejection surface in which a plurality of nozzles are arranged two-dimensionally; a scanning device which conveys at least one of the liquid ejection head and an image formation receiving medium on which liquid ejected from the plurality of nozzles is deposited, to cause relative movement between the image formation receiving medium and the liquid ejection head in a first direction; a motor which is a driving source for driving the scanning device; and a drive force transmission mechanism which transmits drive force generated by the motor to the scanning device, the method comprising the steps of:

obtaining information indicating, in a case where rotational non-uniformity can occur Nm times for each revolution of the motor (where Nm is a natural number), a spatial period representing an amount of the relative movement in the first direction on the image formation receiving medium corresponding to 1/Nm revolution of the motor;

acquiring information indicating an offset distance in the first direction of a pair of nozzles which form dots that are mutually adjacent in a second direction perpendicular to the first direction on the image formation receiving medium, of the plurality of nozzles arranged two-dimensionally; and modifying a speed reduction ratio of the drive force transmission mechanism in such a manner that relationship of OSy≈k×Pv, where k is a natural number, Pv represents the obtained spatial period and OSy represents the acquired offset distance, is satisfied.

* * * * *